US009518375B2

(12) United States Patent
Uchida et al.

(10) Patent No.: US 9,518,375 B2
(45) Date of Patent: Dec. 13, 2016

(54) TURNING WORKING VEHICLE

(71) Applicant: YANMAR CO., LTD., Osaka-shi (JP)

(72) Inventors: Zenzo Uchida, Chikugo (JP); Masamitsu Uemura, Chikugo (JP); Masami Miyanishi, Chikugo (JP)

(73) Assignee: YANMAR CO., LTD., Osaka (JP)

( * ) Notice: Subject to any disclaimer, the term of this patent is extended or adjusted under 35 U.S.C. 154(b) by 0 days.

(21) Appl. No.: 14/403,956

(22) PCT Filed: Feb. 19, 2013

(86) PCT No.: PCT/JP2013/053947
§ 371 (c)(1),
(2) Date: Nov. 25, 2014

(87) PCT Pub. No.: WO2013/179695
PCT Pub. Date: Dec. 5, 2013

(65) Prior Publication Data

US 2015/0130219 A1 May 14, 2015

(30) Foreign Application Priority Data

May 28, 2012 (JP) ..... 2012-121228

(51) Int. Cl.
*E02F 9/16* (2006.01)
*E02F 9/26* (2006.01)
(Continued)

(52) U.S. Cl.
CPC ..... *E02F 9/16* (2013.01); *E02F 3/325* (2013.01); *E02F 9/0858* (2013.01); *E02F 9/2004* (2013.01); *E02F 9/26* (2013.01)

(58) Field of Classification Search
CPC ..... E02F 9/16; E02F 9/2004; E02F 9/26; E02F 9/0858; E02F 3/325
See application file for complete search history.

(56) References Cited

U.S. PATENT DOCUMENTS 4,733,745 A 3/1988 Lumpkins
5,924,515 A 7/1999 Stauffer
(Continued)

FOREIGN PATENT DOCUMENTS

CN 101545276 A 9/2009
EP 1538267 A1 6/2005
(Continued)

OTHER PUBLICATIONS

International Search Report; International Application No. PCT/JP2013/053947; May 28, 2013.
(Continued)

*Primary Examiner* — Glenn Dayoan
*Assistant Examiner* — Melissa A Black
(74) *Attorney, Agent, or Firm* — Sterne, Kessler, Goldstein & Fox P.L.L.C.

(57) ABSTRACT

A turning working vehicle is provided with a monitor arrangement structure where a driver's seat is arranged on an operation part disposed on a turning body, and a working part manipulation lever which manipulates a working part and a monitor which displays various information are disposed on either one of left and right sides of the driver's seat. The monitor is arranged in an upright state outside and in front of the working part manipulation lever, and a display screen of the monitor is directed toward a viewpoint side of an operator seated on the driver's seat and performing manipulation while viewing a front side. An outer manipulation lever is arranged in an upright state behind the monitor thus allowing the operator to view the display screen of the monitor between the outer manipulation lever and the working part manipulation lever within a field of vision of the operator.

7 Claims, 25 Drawing Sheets

(51) Int. Cl.

| | |
|---|---|
| ***E02F 9/20*** | (2006.01) |
| ***E02F 3/32*** | (2006.01) |
| ***E02F 9/08*** | (2006.01) |

(56) References Cited

U.S. PATENT DOCUMENTS

| | | | |
|---|---|---|---|
| 2006/0287841 | A1 | 12/2006 | Hoshi et al. |
| 2009/0244106 | A1 | 10/2009 | Kuwae et al. |
| 2010/0212450 | A1 | 8/2010 | Miyasaka et al. |

FOREIGN PATENT DOCUMENTS

| | | | | |
|---|---|---|---|---|
| EP | 2105339 | A1 | | 9/2009 |
| JP | U H0297445 | A | | 8/1990 |
| JP | 2002-061222 | A | | 2/2002 |
| JP | 2003-184131 | A | | 7/2003 |
| JP | 2004-249843 | A | | 9/2004 |
| JP | 2006016916 | A | * | 1/2006 |
| JP | 2006-336328 | A | | 12/2006 |
| JP | 2009-236617 | A | | 10/2009 |
| JP | 2010-270443 | A | | 12/2010 |
| KR | 2009-0102638 | A | | 9/2009 |

OTHER PUBLICATIONS

European Search Report for EP 13 79 6633 mailed May 18, 2016, 7 pages.

* cited by examiner

TURNING WORKING VEHICLE

TECHNICAL FIELD

The present invention relates to a turning working vehicle, and more particularly to the monitor arrangement structure of a turning working vehicle.

BACKGROUND ART

Conventionally, as one mode of the monitor arrangement structure of a turning working vehicle, there has been known a turning working vehicle disclosed in patent literature 1. That is, patent literature 1 discloses the monitor arrangement structure where a driver's seat is arranged in an operation part disposed on a turning body, a lever support case is disposed on a right side of the driver's seat, a working part manipulation lever for manipulating a working part is mounted on a front portion of the lever support case, and a monitor which displays various information is disposed on a rear end portion of the lever support case.

CITATION LIST

Patent Literature

PTL 1: JP-A-2003-184131

SUMMARY OF INVENTION

Technical Problem

However, in the above-mentioned monitor arrangement structure, the monitor is disposed on the rear end portion of the lever support case. Accordingly, the arrangement position of the monitor is located below a right arm of an operator who grips the working part manipulation lever and hence, the operator cannot view the monitor while performing a lever manipulation and viewing a front side. That is, the above-mentioned monitor arrangement structure has a drawback that the operator cannot perform the lever manipulation and the monitor checking operation simultaneously.

Accordingly, it is an object of the present invention to provide a turning working vehicle which allows an operator to perform a lever manipulation and a monitor checking operation simultaneously.

Solution to Problem

A turning working vehicle according to the invention described in claim 1 is provided with a monitor arrangement structure where a driver's seat is arranged on an operation part disposed on a turning body, and a working part manipulation lever which manipulates a working part and a monitor which displays various information are disposed on either one of left and right sides of the driver's seat, wherein the monitor is arranged in an upright state outside and in front of the working part manipulation lever, and a display screen of the monitor is directed toward a viewpoint side of an operator who is seated on the driver's seat and performs a manipulation while viewing a front side, an outer manipulation lever is arranged in an upright state behind the monitor thus allowing the operator to view the display screen of the monitor through between the outer manipulation lever and the working part manipulation lever within a field of vision of the operator.

In such a turning working vehicle, within a field of vision of the operator who is seated on the driver's seat and performs a manipulation while viewing a front side, the operator can view the display screen of the monitor directed toward a viewpoint side of the operator through between the outer manipulation lever and the working part manipulation lever. Accordingly, the operator can surely view the display screen of the monitor while manipulating the working part manipulation lever or the outer manipulation lever. As a result, an operation efficiency can be increased while ensuring safety during the operation.

The turning working vehicle according to the invention described in claim 2 is, in the turning working vehicle according to the invention described in claim 1, characterized in that an upper end portion of the working part manipulation lever, an upper end portion of outer manipulation lever, and a center portion of the display screen of the monitor are sequentially arranged from the driver's seat to the outside on one side, a height of the operation part from a floor portion is disposed at a low position, a center portion of the display screen of the monitor, the upper end portion of the working part manipulation lever and the upper end portion of the outer manipulation lever are arranged sequentially from a front side to a rear side thus allowing the operator to view the display screen of the monitor arranged outside and below through between the outer manipulation lever and the working part manipulation level within a field of vision of the operator.

In such a turning working vehicle, the operator can view the display screen of the monitor arranged outside and below the driver's seat through between the outer manipulation lever and the working part manipulation lever within a vision of the field of the operator and hence, the working part manipulation lever, the outer manipulation lever or a right hand of the operator who grips and manipulates either one of these levers dose not obstruct the operator's viewing of the display screen of the monitor. Accordingly, the operator can easily view the display screen of the monitor arranged outside and below the driver's seat.

The turning working vehicle according to the invention described in claim 3 is, in the turning working vehicle according to the invention described in claim 1 or 2, characterized in that a monitor manipulation switch is disposed in the vicinity of the display screen of the monitor, and the monitor manipulation switch is configured to allow the operator seated on the driver's seat to extend his hand between the working part manipulation lever and the outer manipulation lever and to manipulate the monitor manipulation switch.

In such a turning working vehicle, the operator seated on the driver's seat can easily manipulate the monitor manipulation switch by extending his hand through between the working part manipulation lever and the outer manipulation lever. Accordingly, the operator can readily acquire desired information from the monitor by manipulating the monitor manipulation switch when necessary. As a result, working efficiency can be increased while ensuring safety during working also from this point of view.

The turning working vehicle according to the invention described in claim 4 is, in the turning working vehicle according to the invention described in any one of claims 1 to 3, characterized in that a liquid crystal display having a viewing angle of a fixed angle in the longitudinal direction and in the lateral direction respectively is used as the monitor, and a display screen of the liquid crystal display is arranged to be directed toward an operator side such that a viewpoint of the operator seated on the driver's seat is always disposed within a range of field of vision having a pyramidal shape formed by the viewing field angles in the longitudinal direction and in the lateral direction.

In such a turning working vehicle, the display screen of the liquid crystal display is arranged to be directed toward the operator side such that the viewpoint of the operator seated on the driver's seat is always disposed within a range of field of vision having a pyramidal shape formed by the viewing field angles in the longitudinal direction and in the lateral direction. Accordingly, for example, even when the position of a viewpoint of the operator differs as in the case where the physical structure of the operator differs or as in the case where the driver's seat is adjusted by moving the driver's seat in the longitudinal direction, the field of vision can always cover the viewpoint of the operator. As a result, even when the operator adjusts the driver's seat at the desired position by suitably moving the driver's seat, the display screen of the liquid crystal display surely falls within the field of vision and hence, visibility of the operator can be favorably ensured. Here, a viewing angle in the longitudinal direction can be set to, for example, 50 degrees (25 degrees toward a front side and 25 degrees toward a rear side) in the longitudinal direction of an imaginary reference line raised from a viewpoint. The display screen of the liquid crystal display is arranged by slightly tilting the display screen toward a front side (for example, 5 degrees) thus allowing the operator to easily view the display screen of the liquid crystal display. A viewing angle in the lateral direction can be set to, for example, 50 degrees (25 degrees toward a left side and 25 degrees toward a right side) in the lateral direction of an imaginary reference line raised from a viewpoint.

Advantage of the Invention

The present invention can acquire an advantageous effect that an operator can surely view a display screen of a monitor while manipulating a working part manipulation lever or an outer manipulation lever so that working efficiency can be increased while ensuring safely during an operation.

MODE FOR CARRYING OUT THE INVENTION

Hereinafter, the embodiment of the present invention is explained by reference to drawings. Symbol A shown in FIG. 1 to FIG. 7 indicates an excavation working vehicle which constitutes a turning working vehicle according to the present invention.

[Schematic Explanation of the Whole Excavation Working Vehicle]

As shown in FIG. 1 to FIG. 7, the excavation working vehicle A is constituted of: a traveling machine body 1 which is capable of self-traveling, an excavation part 2 and an earth removing part 3 which are constituted as a working part mounted on the traveling machine body 1. In this embodiment, as a working attachment, a bucket 13 for excavation is mounted on a distal end portion of the working part, and the bucket 13 constitutes the excavation part 2.

Figure 14:
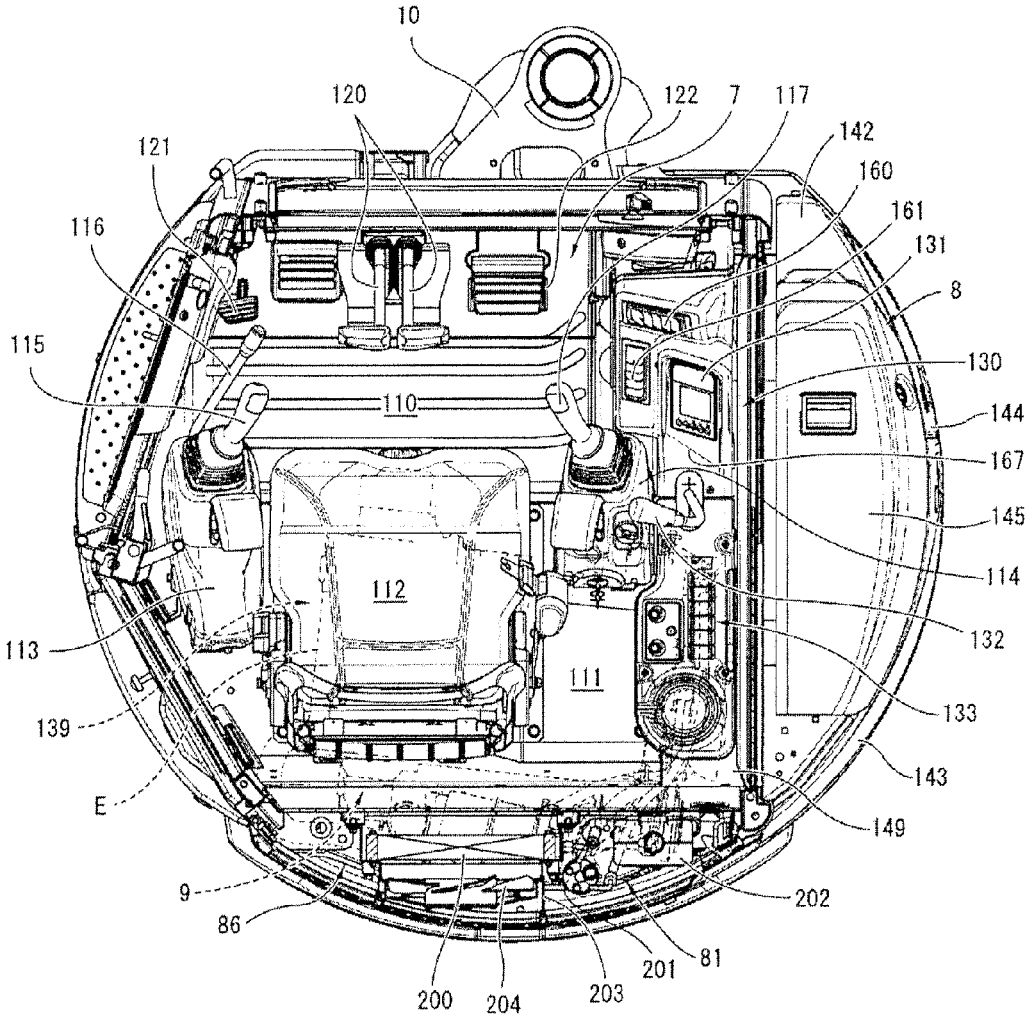
FIG. 14 is an explanatory cross-sectional plan view of an operation part.
Figure 18:
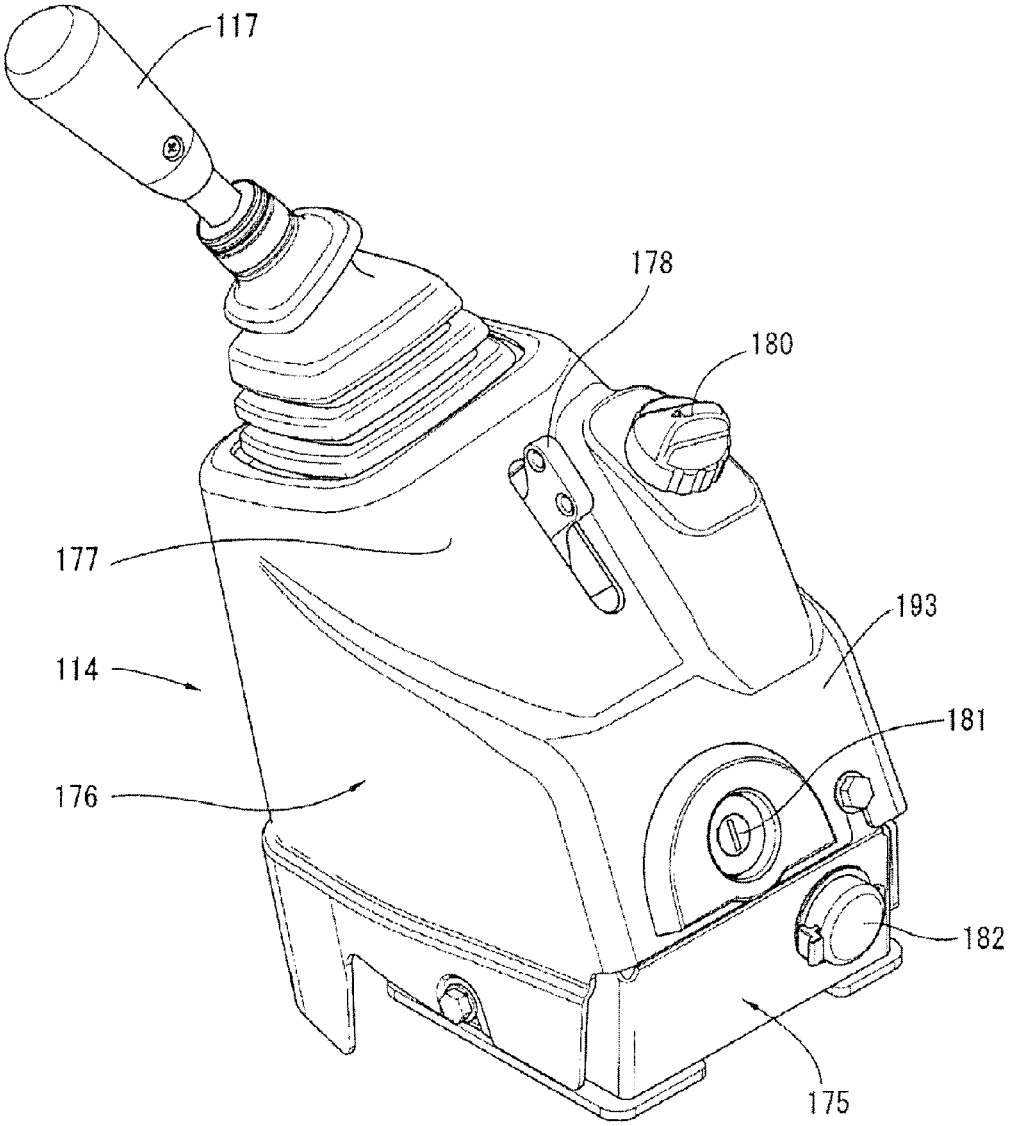
FIG. 18 is a back perspective view of a right lever support case.

The traveling machine body 1 is capable of performing straight traveling in the back-and-forth direction and is also capable of performing turning traveling in the back-and-forth direction as well as in the left-and-right direction by rotatably driving a pair of left and right crawler-type traveling parts 4, 4 in the normal direction and the reverse direction respectively, and is also capable of performing sudden turning by rotatably driving the left and right traveling parts 4, 4 in the directions opposite to each other respectively. A base 5 is interposed between the traveling parts 4, 4, and a turning body 6 is mounted on the base 5 in a turnable manner. The turning body 6 is capable of turning in either the leftward or rightward direction about a vertically extending axis of a center portion. The turning body 6 is formed into an approximately disc shape as viewed in a plan view, and is turnable within a lateral width of the traveling parts 4, 4 (a distance between an outer edge portion of the left traveling part 4 and an outer edge portion of the right traveling part 4). As shown in FIG. 14 and FIG. 18, an operation part 7 and a tank portion 8 are disposed on a front half portion of the turning body 6, while a function part 9 is disposed on a rear half portion of the turning body 6. The operation part 7 and the function part 9 are surrounded by a cabin 30 described later. An excavation part stay 10 is mounted on the turning body 6 in a frontwardly projecting manner at a position close to one side of a front end portion of the turning body 6 (close to a right side in this embodiment), and a proximal end portion of the excavation part 2 is pivotally mounted on the excavation part stay 10. The earth removing part 3 is mounted on the base 5 between the pair of left and right traveling parts 4, 4.

The excavation part 2 includes a boom 11, an arm 12 and the bucket 13. The excavation part 2 further includes a swing cylinder 14, a boom cylinder 15, an arm cylinder 16 and a bucket cylinder 17 which rotatably operate the boom 11, the arm 12 and the bucket 13 respectively.

Figure 4:
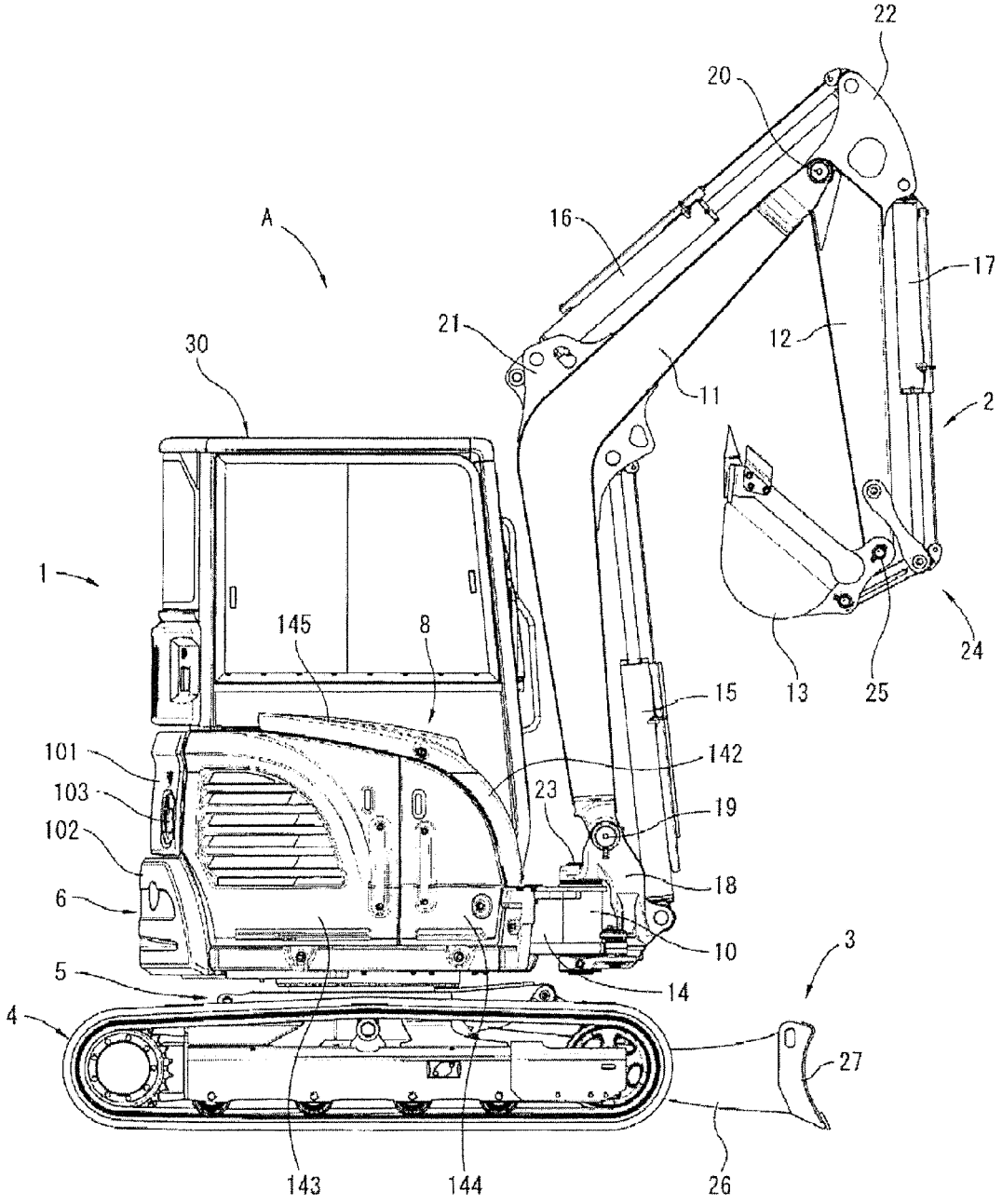
FIG. 4 is a right side view of the turning working vehicle (excavation working vehicle) according to the present invention.
Figure 5:
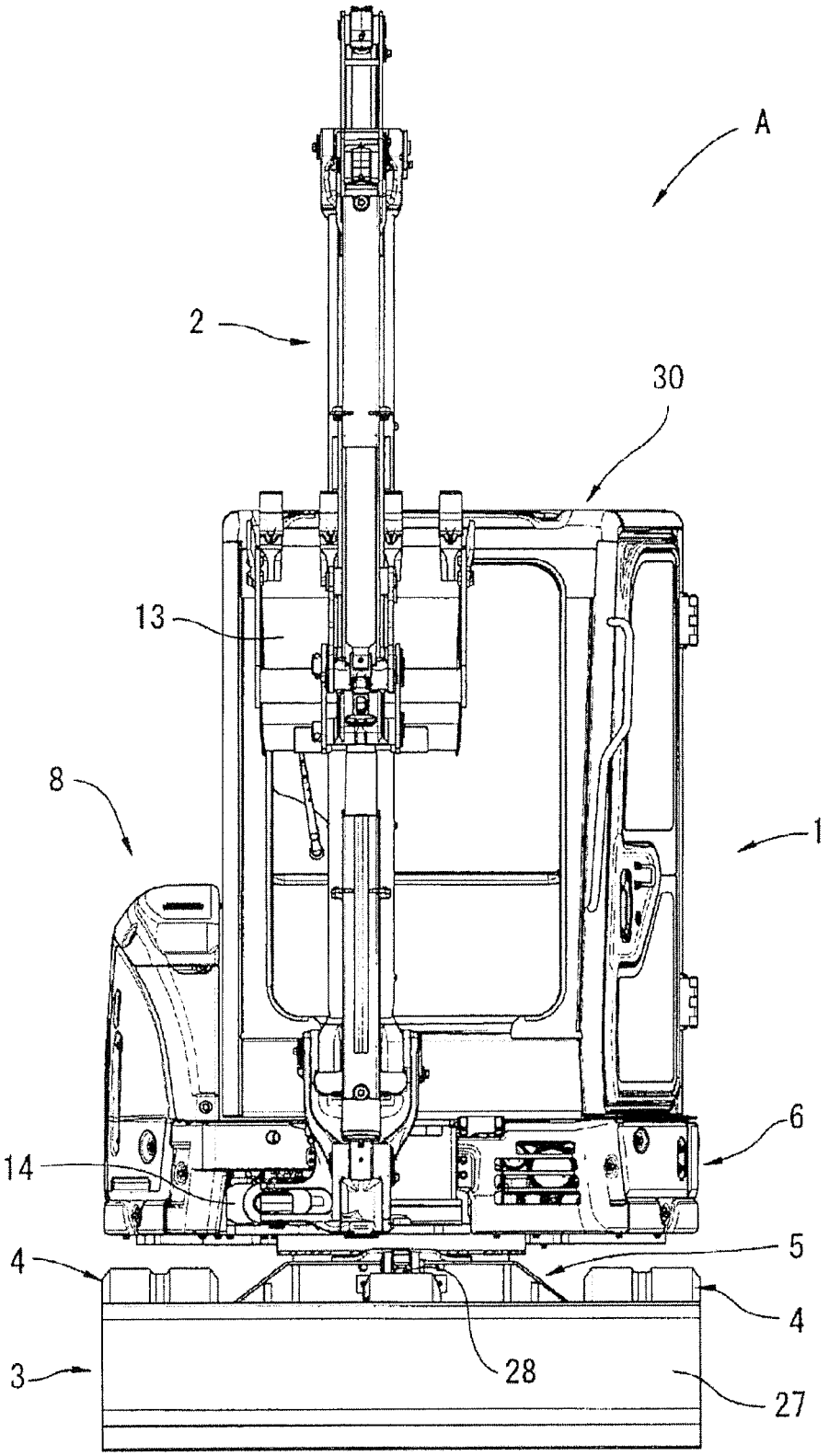
FIG. 5 is a front view of the turning working vehicle (excavation working vehicle) according to the present invention.

As shown in FIG. 4, on the excavation part stay 10 which is mounted in a projecting manner on the turning body 6 at a position close to a right side of the front end portion of the turning body 6, a swing body 18 is pivotally mounted on the pivot shaft 23 having an axis thereof directed in the vertical direction in such a manner that the swing body 18 is swingable about a pivot shaft 23 in the left-and-right direction. The swing cylinder 14 which extends and contracts in the back-and-forth direction is interposed between a right intermediate portion of the turning body 6 and a right front portion of the swing body 18, and the swing body 18 is swung (laterally swung) in an interlocking manner with the extending and contracting operation of the swing cylinder 14.

The boom 11 which is bent into an "L shape" as viewed in a side view and extends in the vertical direction is mounted on the swing body 18 in a vertically rotatable manner about a first pivot shaft 19 in a state where a proximal end portion of the boom 11 is pivotally supported on the first pivot shaft 19 having an axis thereof directed in the left-and-right direction. The boom cylinder 15 which extends and contracts in the vertical direction is interposed between a front end portion of the swing body 18 and a front intermediate portion of the boom 11, and the boom 11 is rotatably operated in the vertical direction in an interlocking manner with the extending and contracting operation of the boom cylinder 15.

The arm 12 is mounted on a distal end portion of the boom 11 in a rotatable manner in the back-and-forth direction (vertically rotatable manner) about a second pivot shaft 20 in a state where a proximal end portion of the arm 12 extending in the vertical direction is pivotally supported on the second pivot shaft 20 having an axis thereof directed in the left-and-right direction. The arm cylinder 16 which extends and contracts in the back-and-forth direction is interposed between a first cylinder mounting body 21 which is mounted on an intermediate portion of an upper surface of the boom 11 and a second cylinder mounting body 22 which is mounted on a proximal end portion of a front surface of the arm 12. Accordingly, the arm 12 is rotatably operated in the back-and-forth direction in an interlocking manner with the extending and contracting operation of the arm cylinder 16.

The bucket 13 is mounted on a distal end portion of the arm 12 in a rotatable manner in the back-and-forth direction (vertically rotatable manner) about a third pivot shaft 25 in a state where a base portion of the bucket 13 is pivotally supported on the third pivot shaft 25 having an axis thereof directed in the left-and-right direction. A bucket link 24 is interposed between the distal end portion of the arm 12 and a base portion of the bucket 13, and the bucket cylinder 17 which is extensible in the vertical direction is interposed between the bucket link 24 and the second cylinder mounting body 22 of the arm 12. Accordingly, the bucket 13 is rotatably operated in the back-and-forth direction (rotated in the vertical direction) in an interlocking manner with the extending and contracting operation of the bucket cylinder 17.

As shown in FIG. 1 to FIG. 7, the earth removing part 3 is provided between a pair of left and right traveling parts 4. The earth removing part 3 is configured such that proximal end portions of a pair of left and right blade arms 26, 26 which extends in the back-and-forth direction are mounted on the base 5 in a liftable manner, and a blade (earth removing plate) 27 which extends in the left-and-right direction extends between distal end portions of both blade arms 26, 26. The blade 27 is formed so as to have approximately the same width as the lateral width of the traveling parts 4, 4. Symbol 28 indicates a blade cylinder.

Due to such a constitution, when an operator controls the traveling parts 4 in the operation part 7, the traveling machine body 1 can perform the straight traveling in the back-and-forth direction and the turning traveling in the left-and-right directions as he desires. When the operator controls the excavation part 2 in the operation part 7, the traveling machine body 1 can perform the excavation operation. Further, when the operator controls the earth removing part 3 in the operation part 7, the traveling machine body 1 can perform the earth removing operation.

[Explanation of Cabin]

As described above, the cabin 30 is mounted on the turning body 6, and surrounds the operation part 7 and the function part 9 except for the tank portion 8. That is, as shown in FIG. 8 to FIG. 13, the cabin 30 is formed into a box shape with a lower surface opened which is defined by a front wall portion 31, a left side wall portion 32, a right side wall portion 33, a rear wall portion 34, and a ceiling portion 35.

Figure 11:
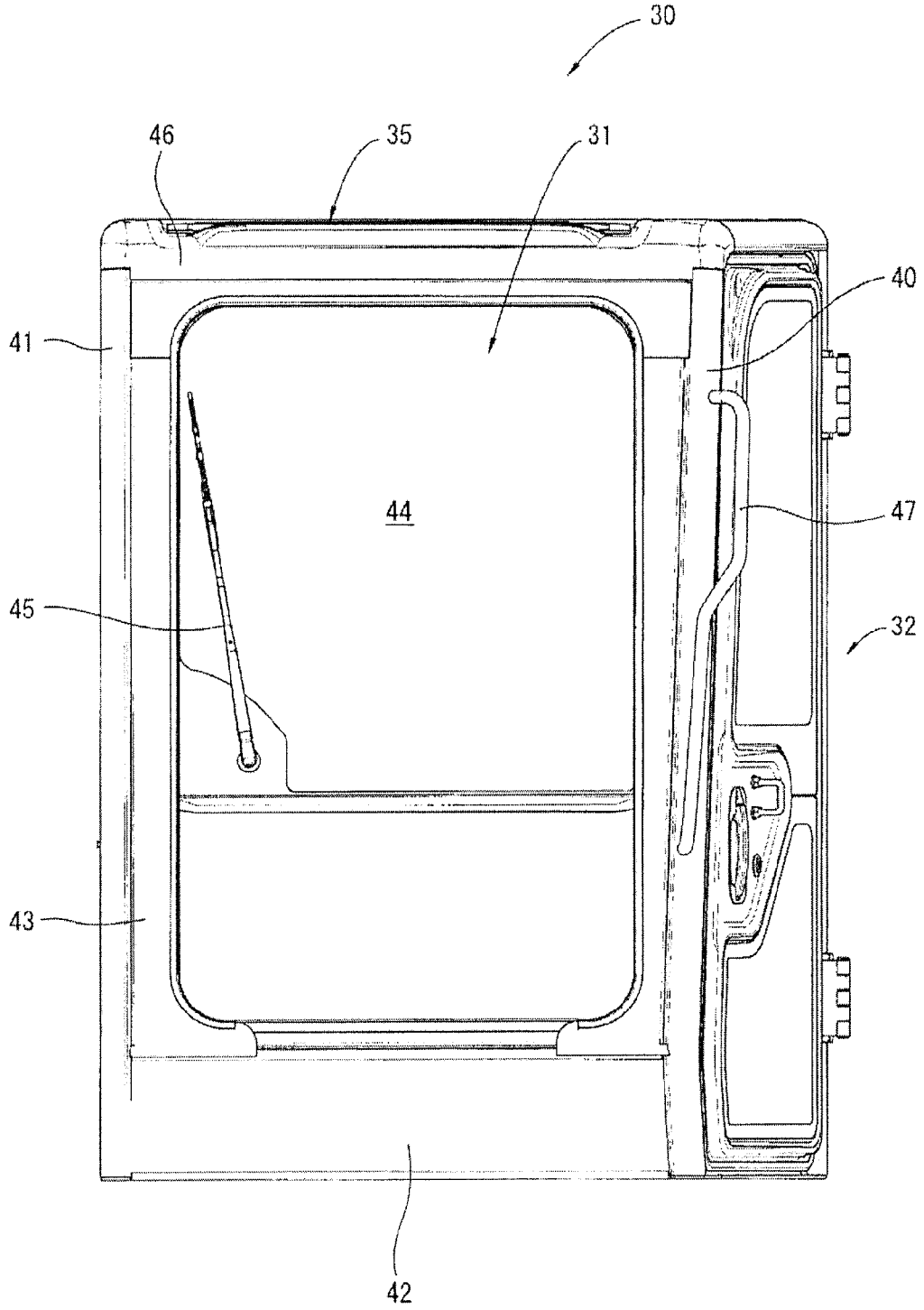
FIG. 11 is a front view of the cabin.

As shown in FIG. 11, the front wall portion 31 is configured such that a lower front wall body 42 extending in the left-and-right direction and having a laterally-elongated rectangular shape extends between lower portions of a pair of left and right front columnar bodies 40, 41 which extends in the vertical direction, a front glass frame body 43 having a vertically-elongated rectangular frame shape extends between upper portions of the front columnar bodies 41, 41, and a front glass 44 is mounted on the front glass frame body 43. Symbol 45 indicates a wiper. The pair of left and right front columnar bodies 40, 41 is formed in a rearwardly-inclined manner such that a rear side of the front columnar bodies 40, 41 is at a high position and a front side of the front columnar bodies 40, 41 is at a low position, and the front columnar bodies 40, 41 have lower portions thereof bent in a frontwardly inclined manner such that a front side is at a high position and a rear side is at a low position. Accordingly, the front glass 44 is mounted on the pair of left and right front columnar bodies 40, 41 in a rearwardly inclined manner, and the lower front wall body 42 below the front glass 44 is mounted in a frontwardly inclined manner. Symbol 46 indicates a front upper lateral member which is mounted between upper end portions of the pair of left and right front columnar bodies 40, 41 in an extending manner in the left-and-right direction, and symbol 47 indicates a hand rail which is mounted on the left front columnar body 40.

Figure 9:
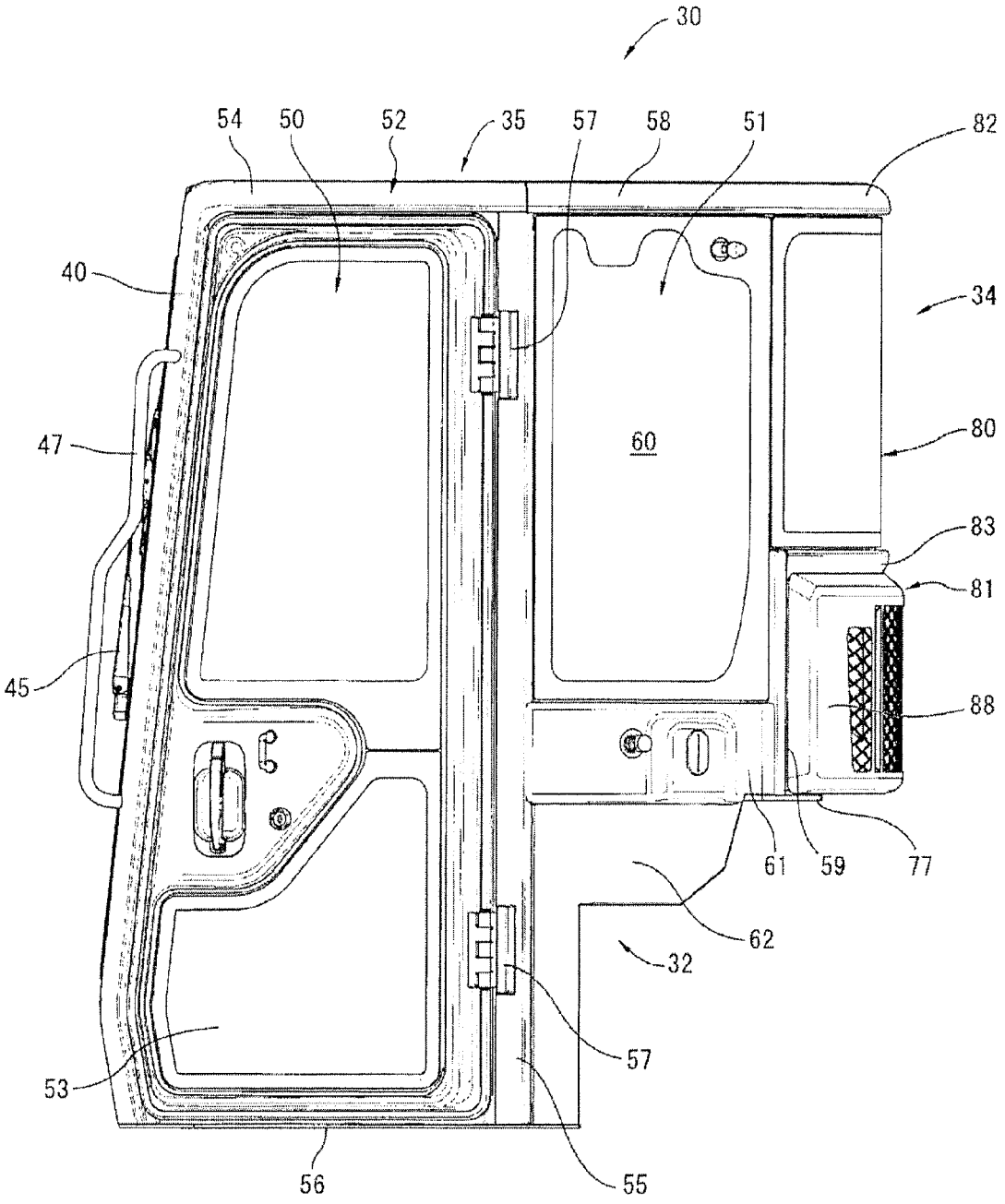
FIG. 9 is a left side view of the cabin.

As shown in FIG. 9, the left side wall portion 32 is formed of a front half side wall portion 50 and a rear half side wall portion 51. The front half side wall portion 50 is formed of a door frame body 52, and an open/close door 53 which is mounted on the door frame body 52 in an openable and closable manner. The door frame body 52 is formed of a left front columnar body 40, a front half upper lateral member 54 which extends horizontally in the rearward and outward direction from an upper end portion of the left front columnar body 40, an intermediate columnar body 55 which has an upper end portion thereof connected to a rear end portion of the front half upper lateral member 54 and extends in the vertical direction, and a plate-like front half lower lateral member 56 which connects a lower end portion of the intermediate columnar body 55 and a lower end portion of the left front columnar body 40 to each other and extends in the back-and-forth direction, and the door frame body 52 is formed into a frame shape as viewed in a left side view. The open/close door 53 has an outer profile along an inner peripheral portion of the door frame body 52, and a rear edge portion of the open/close door 53 is pivotally supported on and connected to the intermediate columnar body 55 by way of upper and lower hinges 57, 57 so that the open/close door 53 can be opened and closed by rotating a front edge portion side of the open/close door 53 about the pivotally-supporting and connecting portion.

The rear half side wall portion 51 of the left side wall portion 32 is configured such that a rear half upper lateral member 58 extends horizontally in the rearward and inward direction from an upper end portion of the intermediate columnar body 55, an upper end portion of a left rear columnar body 59 which extends in the vertical direction is connected to a rear end portion of the rear half upper lateral member 58, a left rear half glass window 60 is mounted on most of an inner peripheral portion of the intermediate columnar body 55, the rear half upper lateral member 58, and the left rear columnar body 59, and a door opening receiving body 61 is mounted on a lower edge portion of the left rear half glass window 60. A left lower edge wall 62 which is formed into a hook shape along a lower edge portion of the door opening receiving body 61 and a lower half rear edge portion of the intermediate columnar body 55 is mounted on a lower side of the door opening receiving body 61.

Figure 10:
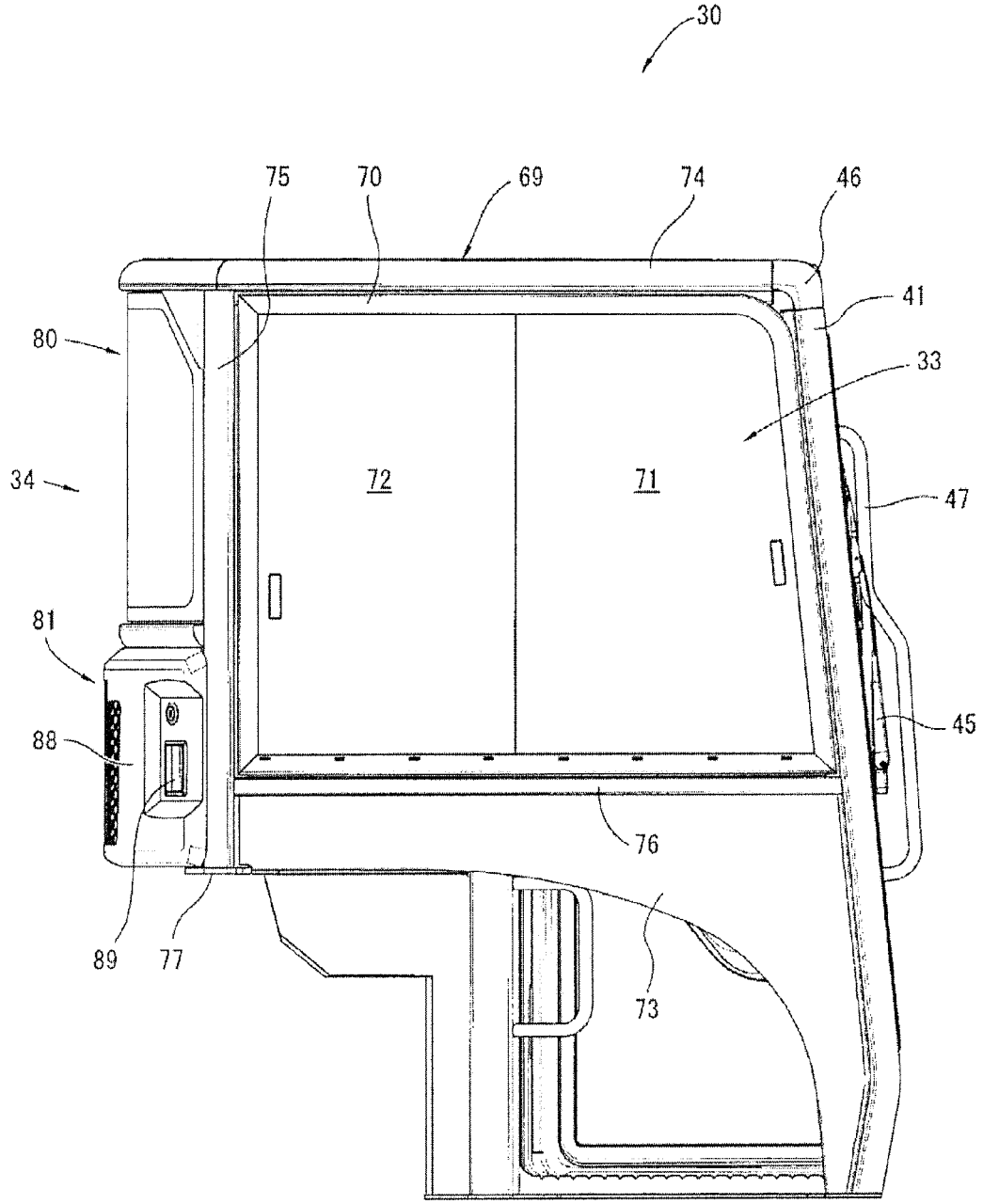
FIG. 10 is a right side view of the cabin.

As shown in FIG. 10, the right side wall portion 33 is configured such that front and rear glass windows 71, 72 are mounted on an upper portion of a right side wall forming frame body 69 in a slidable manner in the back-and-forth direction by way of a window frame body 70, and a right lower edge wall 73 is mounted on a lower portion of the right side wall forming frame body 69. The right side wall forming frame body 69 is formed of a right upper lateral member 74 which extends horizontally in the direct rearward direction from a right end portion of the front upper lateral member 46, a right rear columnar body 75 which has an upper end portion thereof connected to a rear end portion of the right upper lateral member 74 and extends in the vertical direction, and a right intermediate lateral member 76 which extends between a lower portion of the right rear columnar body 75 and an intermediate portion of the right front columnar body 41 and extends in the back-and-forth direction, and an upper portion of the right side wall forming frame body 69 is formed into a frame shape. The right rear columnar body 75 and the left rear columnar body 59 are arranged to face each other in an opposed manner in the left-and-right direction, and a rear lower lateral plate member 77 which extends in the left-and-right direction extends between lower ends of both columnar bodies 59, 75. The right lower edge wall 73 is mounted along a lower half rear edge portion of the right rear columnar body 75, a lower edge portion of the right intermediate lateral member 76, and a lower front edge portion of the right rear columnar body 75, and a lower edge portion of the right lower edge wall 73 are formed into an upwardly projecting shape by bending.

Figure 12:
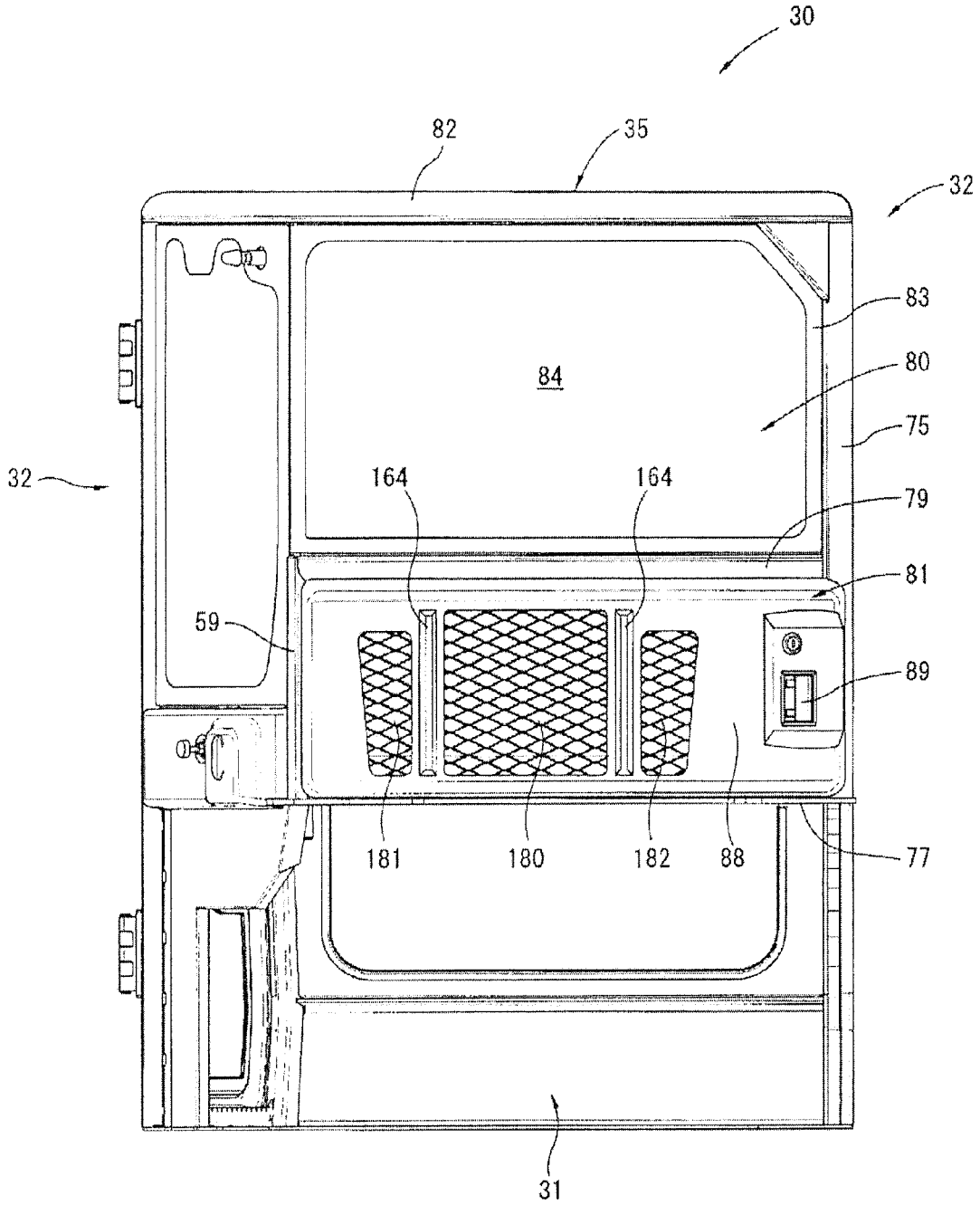
FIG. 12 is a back view of the cabin.

As shown in FIG. 9, FIG. 10 and FIG. 12, the rear wall portion 34 is formed of a rear window portion 80 and a housing part 81 for housing a condenser for an air conditioner and the like which are arranged in the vertical direction. The rear window portion 80 is configured such that a rear upper lateral member 82 which is formed in a rearwardly projecting manner by bending extends between upper end portions of the left and right rear columnar bodies 59, 74, a plate-like rear intermediate partition body 83 which has a rear edge portion thereof projected rearwardly by bending extends between intermediate portions of the left and right rear columnar bodies 59, 75, and a curved rear glass window 84 which has a rectangular shape as viewed in a back view and projects rearwardly as viewed in a plan view is mounted on inner peripheral portions of these rear upper lateral member 82 and the rear intermediate partition body 83 by way of a rear window frame body 79. The housing part 81 for housing a condenser for an air conditioner and the like is configured such that a box-shaped housing part inner wall 85 (see FIG. 15 to FIG. 17) is mounted on an inner peripheral portion which is formed into a laterally-elongated rectangular frame shape by lower half portions of the left and right rear columnar bodies 59, 75, the rear intermediate partition body 83 and the rear lower lateral member 77 in a frontwardly projecting manner so that a recessed housing space 86 (see FIG. 14 and FIG. 15) with a rear surface opened is formed. A left edge portion of an open/close cover 88 is pivotally supported on and is connected to a lower half portion of the left rear columnar body 59 by way of a pivotally support bracket 87 (see FIG. 15) so that the housing space 86 can be opened and closed by the open/close cover 88. Rear edge portions of the open/close cover 88, the rear intermediate partition body 83, and the rear lower lateral member 77 are formed into a curved shape along a shape of a rear peripheral portion of the turning body 6. Symbol 89 indicates a handle for opening and closing the open/close cover 88 mounted on a right portion of the open/close cover 88.

Figure 13:
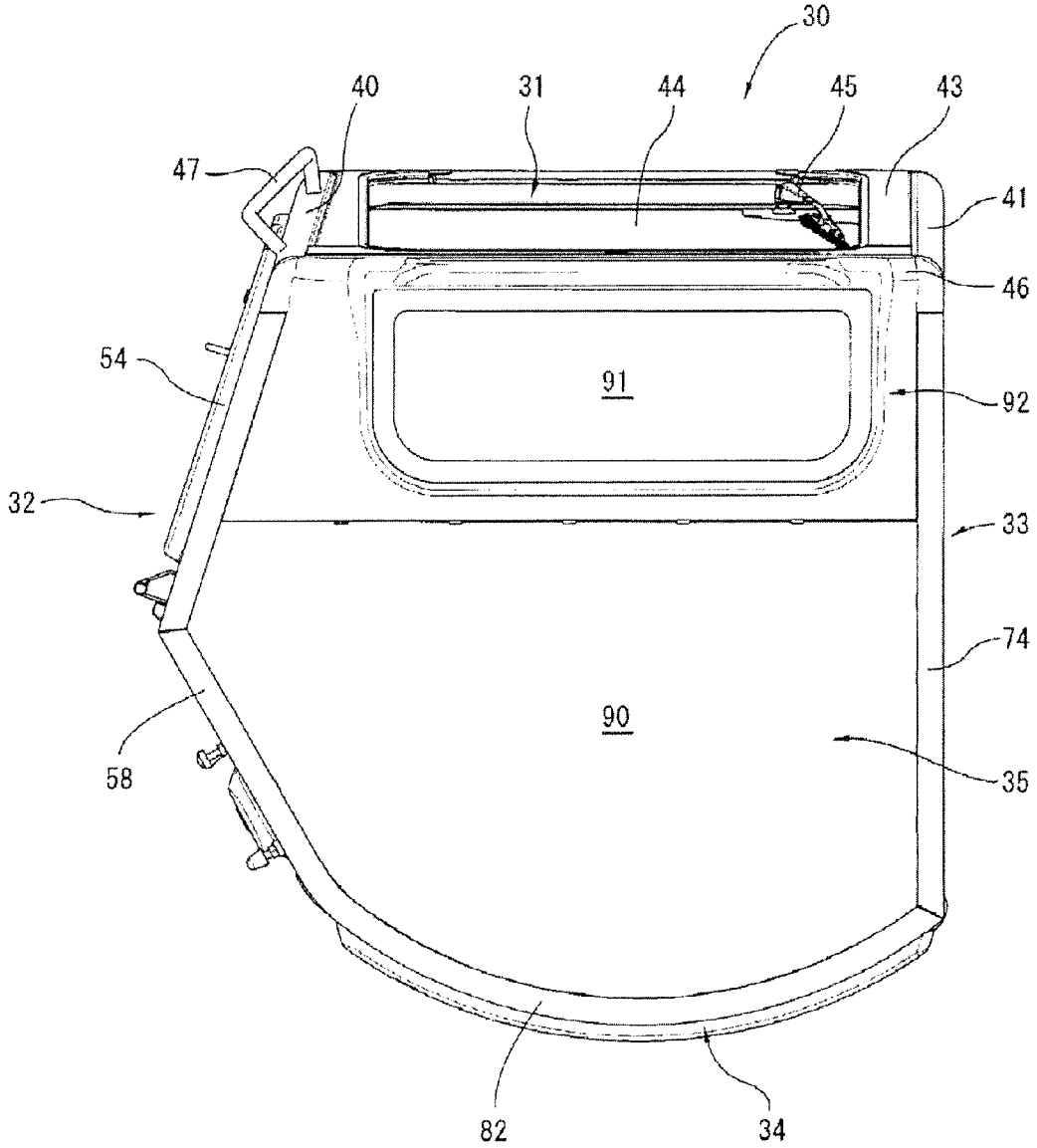
FIG. 13 is a plan view of the cabin.

A shown in FIG. 13, the ceiling portion 35 is configured such that a ceiling plate 90 is mounted on an inner peripheral portion which is formed into a ring shape by the front upper lateral member 46, the front half upper lateral member 54, the rear half upper lateral member 58, the rear upper lateral member 82, and the right upper lateral member 74. A skylight window glass 91 having a laterally-elongated rectangular shape is mounted on a front portion of the ceiling plate 90 thus forming a skylight window 92.

Figure 1:
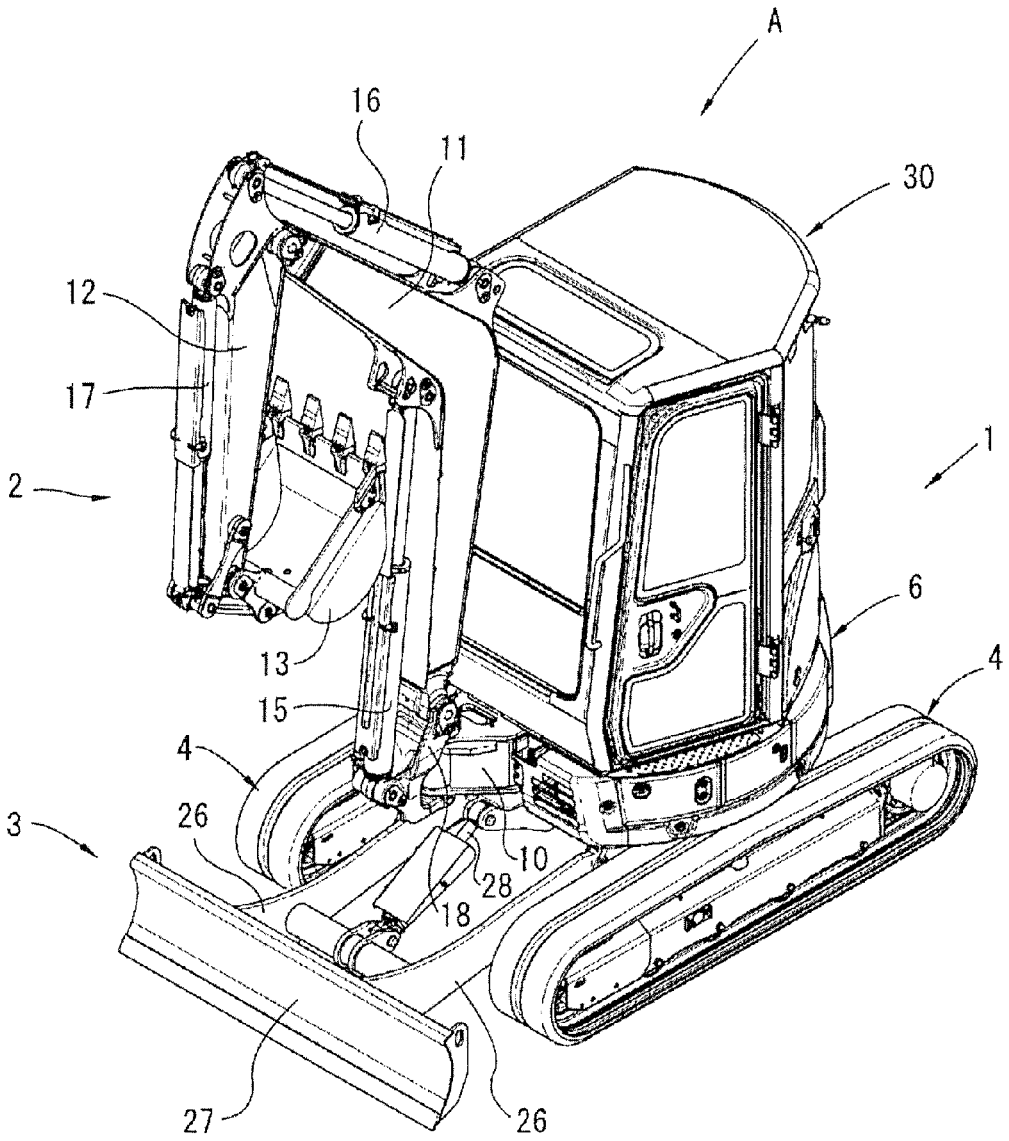
FIG. 1 is a front perspective view of a turning working vehicle (excavation working vehicle) according to the present invention.
Figure 2:
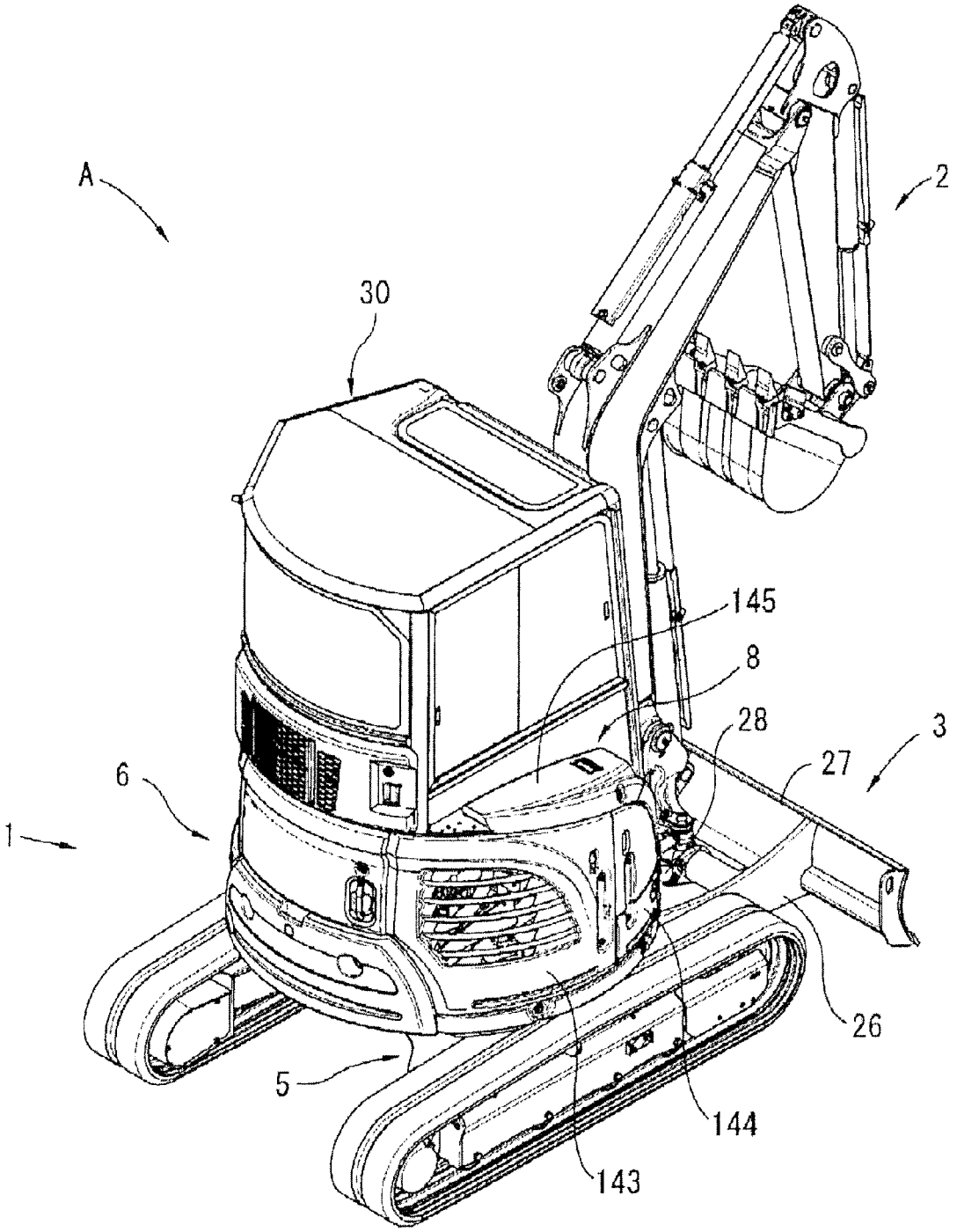
FIG. 2 is a rear perspective view of the turning working vehicle (excavation working vehicle) according to the present invention.
Figure 3:
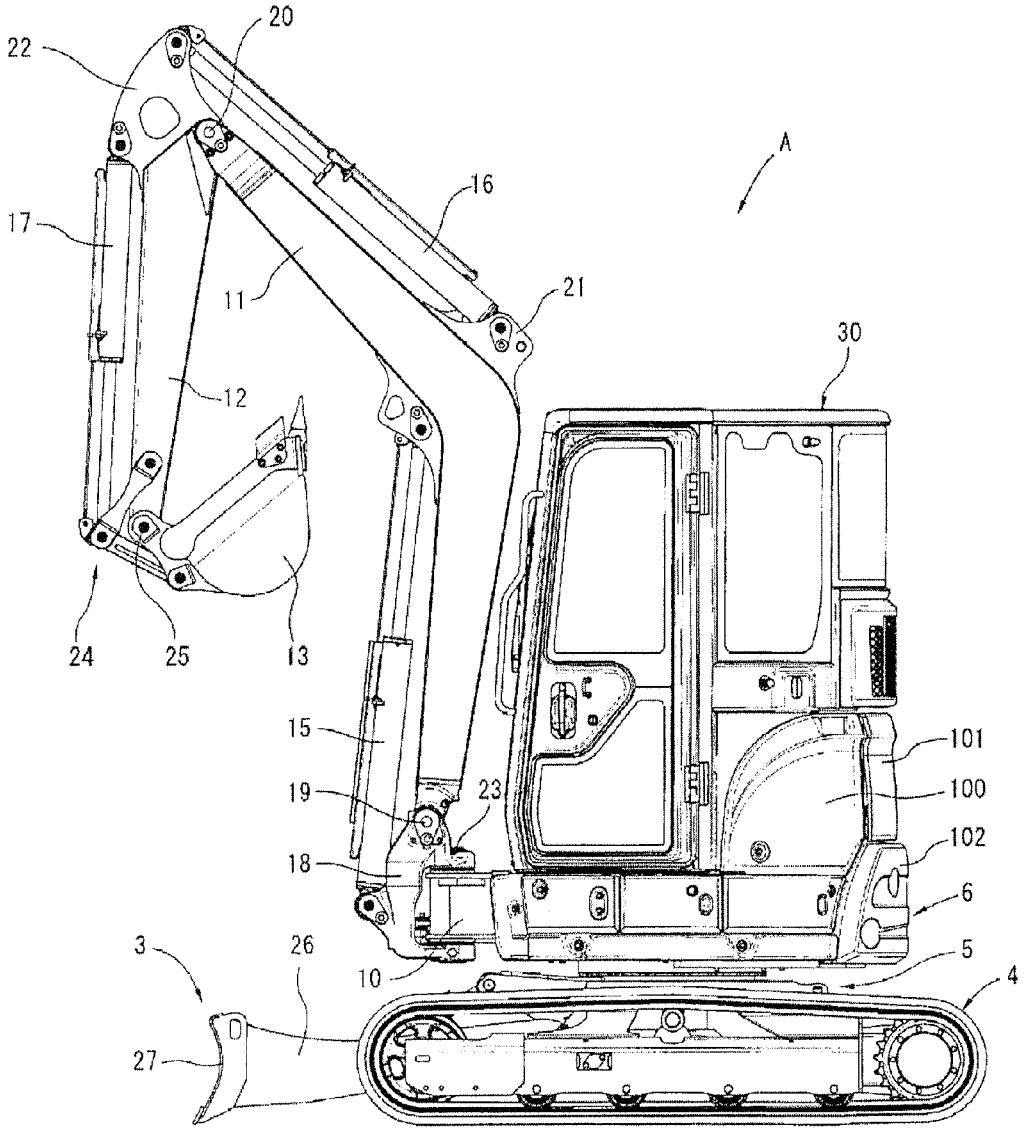
FIG. 3 is a left side view of the turning working vehicle (excavation working vehicle) according to the present invention.
Figure 6:
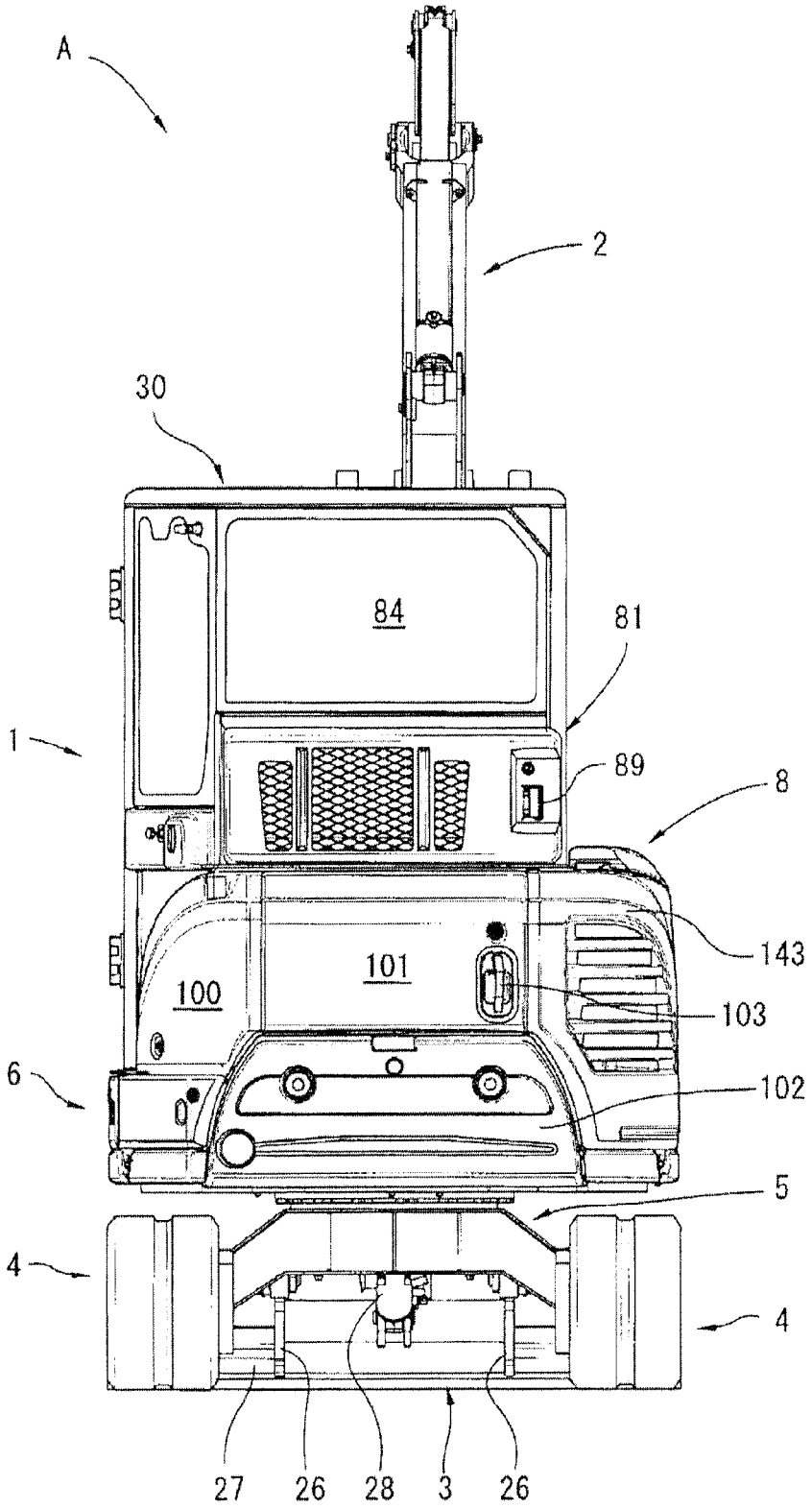
FIG. 6 is a back view of the turning working vehicle (excavation working vehicle) according to the present invention.
Figure 7:
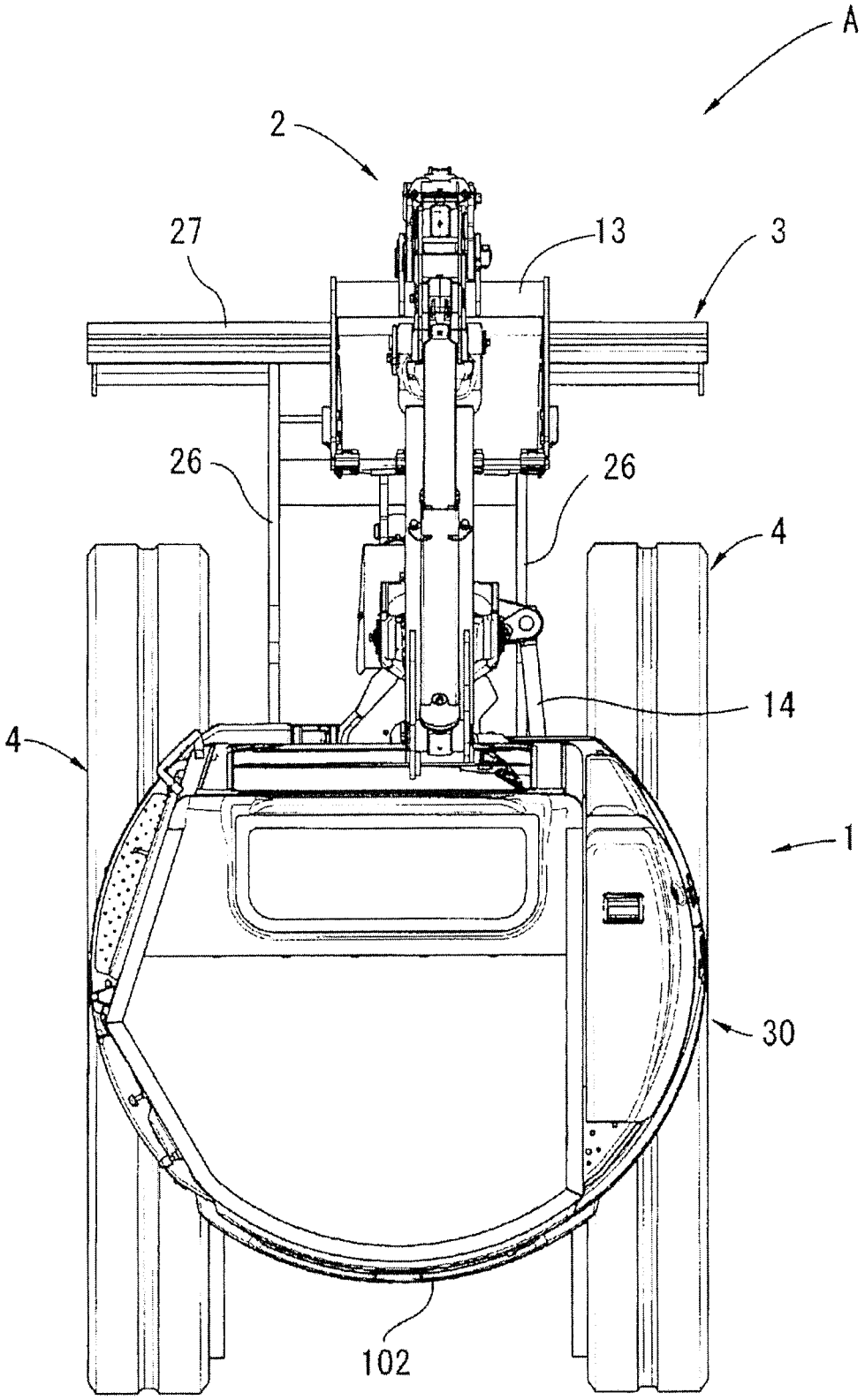
FIG. 7 is a plan view of the turning working vehicle (excavation working vehicle) according to the present invention.
Figure 8:
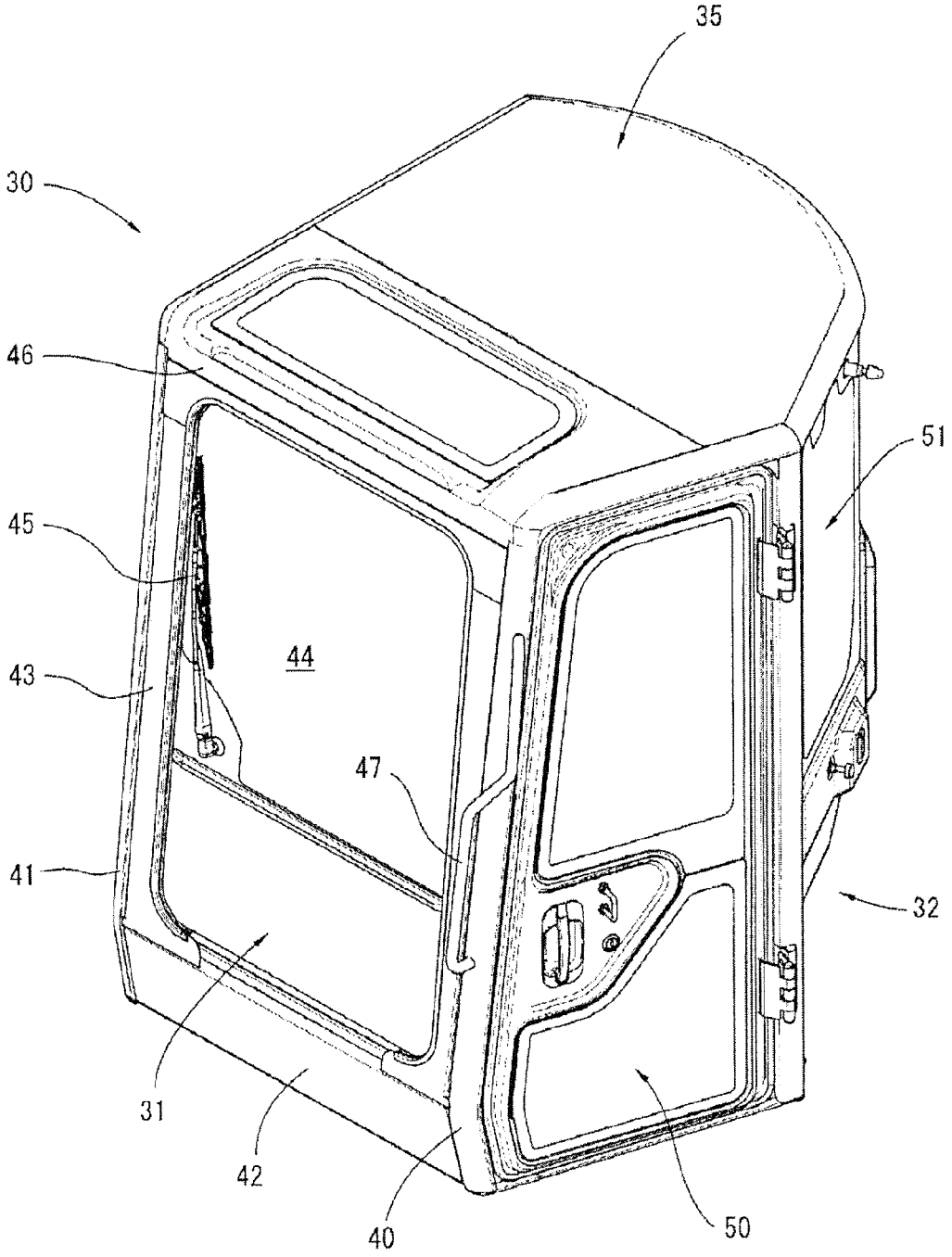
FIG. 8 is a front perspective view of a cabin.

As shown in FIG. 3, FIG. 4 and FIG. 6, a left rear edge wall 100 which is formed by bending along a left rear edge portion of the turning body 6 which is formed into an arc shape as viewed in a plan view is mounted on the left rear edge portion of the turning body 6 in a raised manner, the hood 101 and a counter weight 102 which are formed by bending along a rear edge portion of the turning body 6 are vertically arranged on the rear edge portion of the turning body 6 in hierarchical structure, and the tank portion 8 is arranged on a right rear edge portion of the turning body 6. The cabin 30 surrounds the operation part 7 and the function part 9 by the left rear edge wall 100, the hood 101, the counter weight 102, and the tank portion 8 on the turning body 6. Symbol 103 indicates a hood handle which is formed on a right portion of the hood 101, and the hood 101 can be opened leftwardly and rearwardly by way of the hood handle 103.

[Explanation of Operation Part]

As shown in FIG. 14 and FIG. 18, the operation part 7 is configured such that a front wall of a seat support base (seat mount) 111 is arranged on a rear edge portion of a floor plate member 110 which forms a portion of the turning body 6, and an operator's seat 112 is mounted on a center portion of the seat support base 111. A left lever support case 113 is disposed on a left side of the operator's seat 112 on the seat support base 111, while a right lever support case 114 is disposed on a right side of the operator's seat 112. A left pilot valve (not shown in the drawing) is disposed in the inside of the left lever support case 113, a left operation part manipulation lever 115 projects upwardly from a front upper portion of the left lever support case 113, and the left operation part manipulation lever 115 can be manipulated in a tiltable manner in the back-and-forth direction and in the left-and-right direction.

Further, the left lever support case 113 can change the position thereof between the in-use position where the left lever support case 113 is arranged approximately horizontally and the non-use position where the left lever support case 113 is flipped up rearwardly and upwardly about a rear portion thereof. Symbol 116 indicates a lock lever which projects frontwardly from a front end wall of the left lever support case 113.

A right pilot valve (not shown in the drawing) is disposed in the inside of the right lever support case 114, a right operation part manipulation lever 117 projects upwardly from a front upper portion of the right lever support case 114, and the right operation part manipulation lever 117 can be manipulated in a tiltable manner in the back-and-forth direction and in the left-and-right direction.

Left and right traveling levers 120, 120 which extend in the vertical direction through lever holes formed in a front center portion of the floor plate member 110 are provided in an erected manner just in front of the operator's seat 112, and the respective traveling levers 120, 120 can be manipulated in a tiltable manner in the back-and-forth direction. Traveling hydraulic motors for the traveling parts 4, 4 are hydraulically connected to the respective traveling levers 120, 120 by way of traveling control valves (not shown in the drawing), and traveling of the traveling parts 4, 4 can be controlled by interlocking the rotation of the traveling hydraulic motors in the normal direction or in the reverse direction with tilting of the respective traveling levers 120, 120 in the back-and-forth direction. Symbol 121 is an accelerating pedal which is mounted on the floor plate member 110 at a position in the vicinity of a left side of the left traveling lever 120, and a vehicle speed is accelerated by stepping-on the acceleration pedal 121. Symbol 122 indicates a boom swing control pedal which is mounted on the floor plate member 110 at a position in the vicinity of a right side of the right traveling lever 120.

An operation panel part 130 having a long width in the longitudinal direction and a short width in the lateral direction is arranged adjacent to the right lever support case 114 on a right side of the right lever support case 114. The operation panel part 130 is configured such that a rear portion of a panel part body 150 which extends in the longitudinal direction and is formed into a box shape with an lower end opened is placed on a panel support base 149 having a stepped projecting shape which is contiguously mounted on a right side of the seat support base 111, and a front portion of the panel part body 150 is communicably connected to an upper end opening portion of a cooled air and heated air discharge portion 148 which is arranged adjacent to a front side of the panel support base 149. A monitor 131 which constitutes a display is mounted on a front portion of an upper surface of the panel part body 150. A blade lever 132 is disposed in a projecting manner on an intermediate portion of the upper surface of the panel part body 150 such that the blade lever 132 can be manipulated in a longitudinally tiltable manner. A group of various switches 133 is disposed on a rear portion of an upper surface of the panel part body 150. The blade lever 132 is interlockingly connected to a blade cylinder control valve (not shown in the drawing) by way of an interlocking mechanism 136. The blade cylinder control valve is hydraulically connected to the blade cylinder 28 of the earth removing part 3. The earth removing part 3 is operated in a liftable manner by interlocking an extending and contracting operation of the blade cylinder 28 with the tilting operation of the blade lever 132 in the fore-and-aft direction. Hereinafter, the constitution of the operation panel part 130 is explained in details.

[Explanation of Operation Panel Part]

Figure 16:
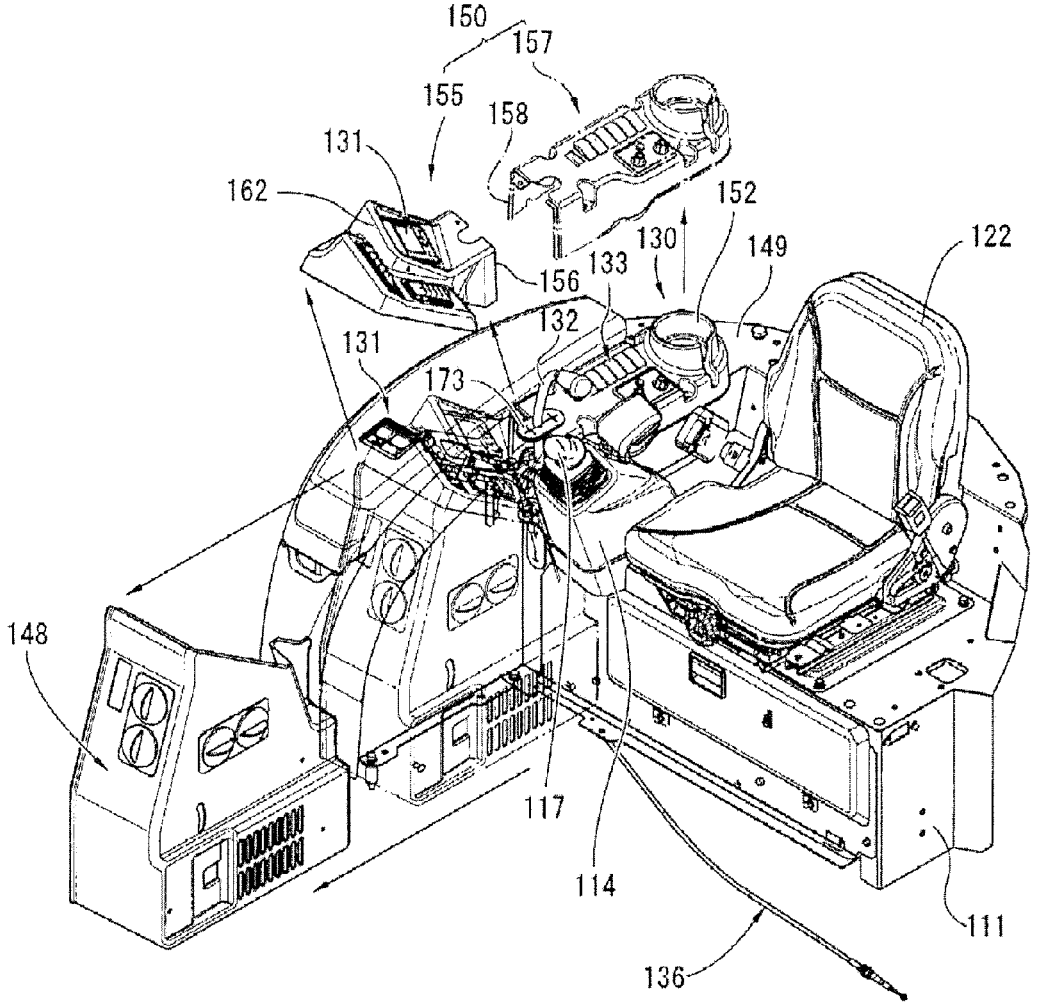
FIG. 16 is an explanatory perspective view of an operation panel part.
Figure 17:
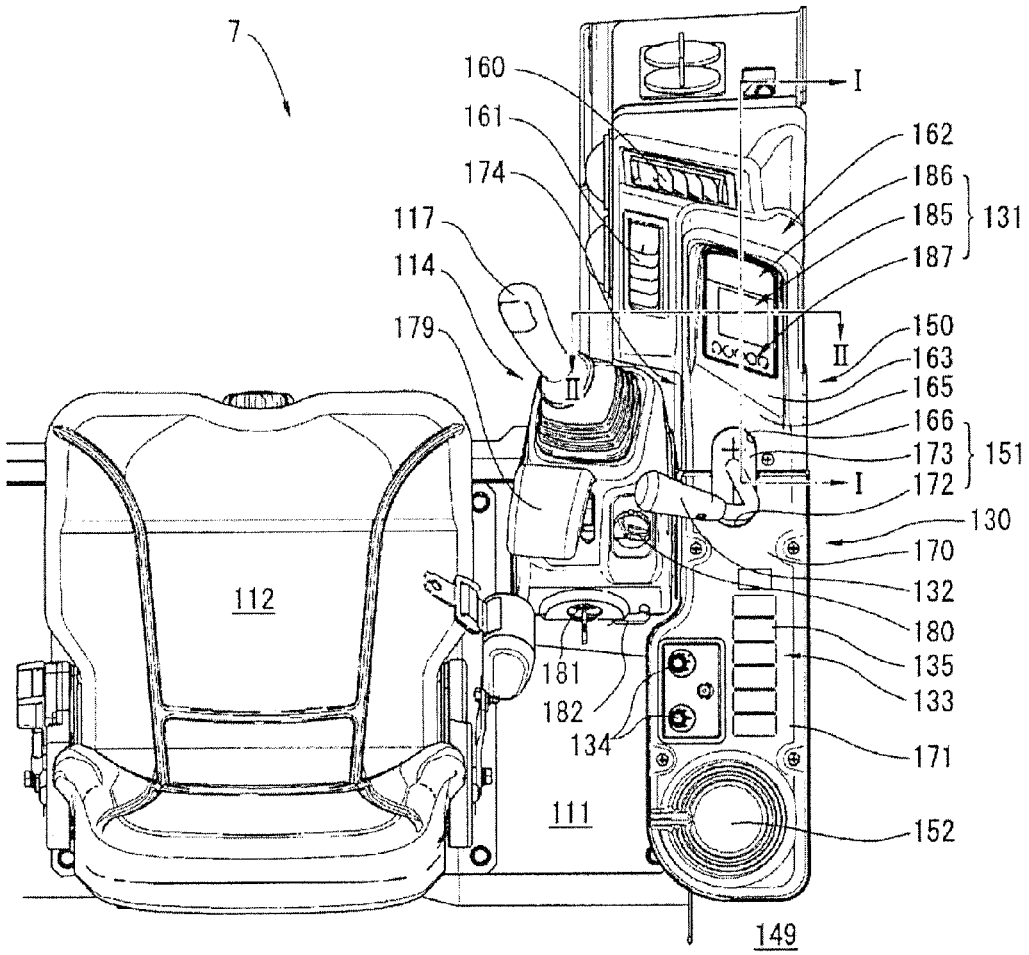
FIG. 17 is an explanatory plan view of the operation panel part.

As shown in FIG. 16 and FIG. 17, the operation panel part 130 is configured such that the blade lever 132 which constitutes an outer manipulation lever is disposed on an outer side of the right working part manipulation lever 117 which constitutes a working part operation manipulation lever by way of the panel part body 150. The panel part body 150 is formed in a longitudinally extending manner, and a through hole portion 151 which allows the blade lever 132 to penetrate therethrough in a vertical direction is formed in an intermediate portion of the panel part body 150. The monitor 131 is disposed in front of the through hole portion 151, while the group of various switches 133 and a cup holder 152 are disposed behind the through hole portion 151. In the through hole portion 151 formed in the panel part body 150, the blade lever 132 is arranged in a vertically penetrating manner. The blade lever 132 is arranged behind and outside the right working part manipulation lever 117.

The panel part body 150 has a front portion thereof inclined such that a front side is high and a rear side is low. The panel part body 150 is also inclined such that an inner side is low and an outer side is high. A display screen of the monitor 131 which is mounted on the front portion of the panel part body 150 is directed to a viewpoint side of an operator seated on the driver's seat 112. On the other hand, the cup holder 152 is mounted on a rear end portion of the panel part body 150. The cup holder 152 is disposed in a rearwardly spaced apart manner from a manipulation range of the right working part manipulation lever 117 and a manipulation range of the blade lever 132.

Due to such a constitution, the through hole portion 151 in which the blade lever 132 is arranged in a vertically penetrating manner is formed in the intermediate portion of the panel part body 150 which is formed in a longitudinally extending manner. The monitor 131 is disposed in front of the through hole portion 151. The group of various switches 133 and the cup holder 152 are disposed on the rear side of the through hole portion 151. Accordingly, the blade lever 132 and the like can be collectively disposed on one side of the driver's seat 112 by way of the panel part body 150 in a compact manner so that the blade lever 132 and the like can be conveniently used.

By arranging the blade lever 132 in the through hole portion 151 formed in the panel part body 150 in a vertically penetrating manner, the blade lever 132 can be surely arranged behind and outside the right working part manipulation lever 117. Accordingly, it is possible to surely take the favorable balance in arrangement position between the blade lever 132 and the right working part manipulation lever 117.

While directing the display screen of the monitor 131 mounted on the front portion of the panel part body 150 toward a viewpoint side of an operator M seated on the driver's seat 112, the cup holder 152 is mounted on the rear end portion of the panel part body 150 in a rearwardly spaced-apart manner from the manipulation range of the right working part manipulation lever 117 and the manipulation range of the blade lever 132 respectively. Accordingly, the operator can easily and surely view the display screen of the monitor 131. Further, when a PET (polyethylene terephthalate) bottle or the like is stored in the cup holder 152, there is no possibility that the PET bottle or the like obstructs the manipulation of the respective levers 117, 132.

[Explanation of Monitor]

Next, the constitution of the monitor 131 is explained by reference to FIG. 17, FIG. 19 to FIG. 22. That is, the monitor 131 is arranged outside and in front of the right working part manipulation lever 117 which is arranged in an upright position. The display screen (an upper surface portion 184 of a monitor case 183) is directed to the viewpoint side of the operator M who is seated on the driver's seat 112 and manipulates the respective levers while viewing a front side. The blade lever 132 is arranged behind the monitor 131 in an upright position. Accordingly, the display screen of the monitor 131 is viewable through between the blade lever 132 and the right working part manipulation lever 117 within a field of vision of the operator M.

An upper end portion of the right working part manipulation lever 117, an upper end portion of the blade lever 132, and a center portion of the display screen of the monitor 131 are arranged sequentially from the driver's seat 112 to one outer side (in this embodiment, a right outer side). The height of the operation part 7 from the floor portion (floor plate member 110) is set at a low position. The center portion of the display screen of the monitor 131, the upper end portion of the right working part manipulation lever 117, and the upper end portion of the blade lever 132 are arranged sequentially from a front side to a rear side. Further, the operator M can view the display screen of the monitor 131 arranged outside and below driver's seat 112 through between the blade lever 132 and the right working part manipulation lever 117 within the field of vision of the operator M.

A group of display part manipulation switches 187 which constitutes monitor manipulation switches is provided to the display screen of the monitor 131. The group of display part manipulation switches 187 is arranged within a range where the operator M seated on the driver's seat 112 can manipulate the group of display part manipulation switches 187 by extending his hand between the right working part manipulation lever 117 and the blade lever 132.

As the monitor 131, a main display part 185 which is a liquid crystal display having predetermined viewing angles α, β in the longitudinal direction and in the lateral direction is used. A display screen portion 189 of the main display part 185 which is a display screen of the liquid crystal display is arranged so as to be directed toward an operator M side such that a viewpoint of the operator M seated on the driver's seat 112 always falls within a quadrangular-pyramid-shaped region of field of vision R formed by the viewing angles α, β in the longitudinal direction and in the lateral direction. Here, the viewing angle α in the longitudinal direction can be set to, for example, 50 degrees (25 degrees toward a front side and 25 degrees toward a rear side) in the longitudinal direction of an imaginary reference line K raised from a viewpoint P. The display screen portion 189 of the main display part 185 is arranged by slightly tilting the display screen portion 189 toward a front side (for example, 5 degrees) thus allowing the operator M to easily view the display screen portion 189. The viewing angle β in the lateral direction can be set to, for example, 50 degrees (25 degrees toward a left side and 25 degrees toward a right side) in the lateral direction of an imaginary reference line K raised from a viewpoint P.

In such a constitution, the operator M can view the display screen of the monitor 131 directed toward a viewpoint side of the operator M through between the blade lever 132 and the right working part manipulation lever 117 within a field of vision of the operator M who manipulates the manipulation lever while viewing a front side in a sitting posture on the driver's seat 112. Accordingly, the operator M can surely view the display screen of the monitor 131 while manipulating the right working part manipulation lever 117 or the blade lever 132. As a result, operation efficiency can be increased while ensuring safety during the operation.

The operator M can view the display screen of the monitor 131 arranged outside and below through between the blade lever 132 and the right working part manipulation level 117 within a vision of the field of the operator M and hence, the right working part manipulation lever 117, the blade lever 132 or a right hand of the operator M who grips and manipulates either one of these levers dose not obstruct the operators viewing of the display screen of the monitor 131. Accordingly, the operator can easily view the display screen of the monitor 131 arranged outside and below the driver's seat 112.

The operator M seated on the driver's seat 112 can easily manipulate the group of display part manipulation switches 187 by extending his hand through between the right working part manipulation lever 117 and the blade lever 132. Accordingly, the operator M can readily acquire desired information from the monitor 131 by manipulating the group of display part manipulation switches 187 when necessary. As a result, working efficiency can be increased while ensuring safety during working also from this point of view.

The display screen of the liquid crystal display, that is, the display screen portion 189 of the main display part 185 is arranged to be directed toward the operator M side such that the viewpoint of the operator M seated on the driver's seat 112 always falls within a range of field of vision R of a pyramidal shape formed by the viewing field angles α, β in the longitudinal direction and in the lateral direction. Accordingly, for example, even when the position of a viewpoint of the operator M differs as in the case where the physical structure of the operator M differs or the case where the driver's seat 112 is adjusted by moving the driver's seat 112 in the longitudinal direction, field of vision R can always cover the viewpoint of the operator M. As a result, even when the operator M adjusts the driver's seat 112 at the desired position by moving the driver's seat 112 when necessary, the display screen portion 189 surely falls within the field of vision and hence, visibility of the operator M can be favorably ensured.

Next, the structure of the operation panel part 130 according to this embodiment is explained more specifically by reference to FIG. 16 to FIG. 22. That is, the panel part body 150 is formed by connecting a body front half portion rear end surface 156 of a body front half portion 155 and a body rear half portion front end surface 158 of a body rear half portion 157 to each other in the longitudinal direction in a connectable and disconnectable manner.

A laterally-extending upper end discharge portion 160 from which cooled air or heated air is discharged is formed on a front portion of the body front half portion 155, a longitudinally-extending upper end discharge portion 161 from which cooled air or heated air is discharged is formed on a left portion of the body front half portion 155, a monitor support portion 162 is formed on a right portion of the body front half portion 155, and the monitor 131 is disposed on the body front half portion 155 by way of a monitor support portion 162. The monitor support portion 162 has an upper surface thereof formed into a longitudinally-elongated quadrangular-shaped recessed surface 163, and the recessed surface 163 is formed into an inclined surface where a front side is high and a rear side is low. The recessed surface 163 is also formed into an inclined surface where an inner side is low and an outer side is high. That is, the recessed surface 163 is directed to eyes m of the operator M seated on the driver's seat 112 (see FIG. 21 and FIG. 22; hereinafter also referred to as a viewpoint) positioned on a left rear upper side of the recessed surface 163, and a visual line Ls of the operator M approximately orthogonally intersects the recessed surface 163. A rear portion 165 is formed on a rearwardly extending portion of the monitor support portion 162, and an upper surface of the rear portion 165 is formed into a horizontal surface. A valley line 167 which extends straightly in the direction from a left front side to a right rear side is formed on a joint portion between the rear portion 165 where the upper surface forms a horizontal surface and the recessed surface 163 which is an inclined surface. A front half through hole portion 166 with an upper surface and a rear end thereof opened is formed in a center portion of an upper surface of the rear portion 165 of the body front half portion 155.

The body rear half portion 157 is an integral body formed of a front portion 170 which has an upper surface thereof formed to have the same lateral width as the rear portion 165 of the body front half portion 155, and a rear portion 171 which has an upper surface thereof formed to have a slightly larger width in the lateral direction than the front portion 170. A rear half through hole portion 172 with an upper surface and a front end thereof opened is formed on a center portion of the upper surface of the front portion 170. The front half through hole portion 166 and the rear half through hole portion 172 are connected to each other in the longitudinal direction thus forming the through hole portion 151 extending in the longitudinal direction. A hole portion cover body 173 made of an elastic material is detachably mounted on the through hole portion 151, and the blade lever 132 is arranged in the through hole portion 151 by way of the hole portion cover body 173 in a vertically penetrating manner. The blade lever 132 can be manipulated in a longitudinally slidable manner, and the through hole portion 151 is made to function as a lever guide groove. A group of various switches 133 is disposed on a front half portion side of the rear portion 171. The group of various switches 133 is formed by arranging volume-type switches 134 and button-type switches 135 adjacent to each other on left and right sides. A cup holder 152 having a recessed shape so as to store a cup, a PET bottle or the like is disposed on a rear half portion side of the rear portion 171.

A left recessed portion 174 is defined by a left rear wall of the front portion of the body front half portion 155, a left wall of the rear portion 165, a left wall of the front portion 170 of the body rear half portion 157, and a left front wall of the rear portion 171. A right side portion of the right lever support case 114 is arranged in the inside of the left recessed portion 174. The right lever support case 114 and the operation panel part 130 are arranged close to each other in the lateral direction in a compact manner.

As shown in FIG. 17 and FIG. 18, the right lever support case 114 is configured such that a case detachable portion 176 is detachably mounted on a case fixed portion 175 mounted on a right side portion of the seat support base 111.

The case detachable portion 176 is configured such that a lower half portion which is formed into a quadrangular cylindrical shape is connected to the case fixed portion 175, and the right working part manipulation lever 117 is disposed on an upper end portion of an upper half portion of the case fixed portion 175 in a projecting manner toward a left front upper side. The upper half portion is formed into a quadrangular pyramid cylindrical shape whose diameter is gradually decreased frontwardly and upwardly. An arm rest 179 is mounted in a projecting manner on a left portion of a rear wall upper portion 177 of the case detachable portion 176 which is formed into a frontwardly-inclined inclined wall by way of an arm rest support body 178, and an acceleration volume 180 which is a volume-type switch is mounted on a right portion of the rear wall upper portion 177 in a projecting manner. The acceleration volume 180 is rotatable about an axis extending in the vertical direction, and is electrically connected to a controller (not shown in the drawing) which controls a rotational speed of the engine E. By rotatably controlling the acceleration volume 180 in the normal direction and in the reverse direction, the increase or the decrease of a rotational speed of the engine E can be adjusted. A key lock portion 181 is provided to a real wall lower portion 193 which is formed into a gently inclined surface. The key lock portion 181 can be rotatably manipulated by inserting an engine key or the like into the key lock portion 181. Due to such a manipulation, the case detachable portion 176 can be connected to the case fixed portion 175 by locking or such locking of the case detachable portion 176 can be released so that it is possible to prevent the occurrence of a case where the detachable portion 176 is removed due to vandalism.

A power source socket 182 (a so-called cigar socket) is disposed on a right side portion of the case fixed portion 175 and hence, electricity can be supplied to external electric equipment from a battery (not shown in the drawing) as a power source via the power source socket 182. For example, a cigar lighter, a connection terminal of a pilot lamp, an adapter of a mobile phone or the like can be connected to the power source socket 182. A pilot lamp which is connected to an outer portion of the cabin 30 can take out electricity from a power source by forming an electric wire insertion hole (not shown in the drawing) in the rear window frame body 83 of the cabin 30 and by connecting a distal end connecting portion of the electric wire to the power source socket 182 by inserting the electric wire into the electric wire insertion hole via a grommet. That is, by connecting a patrol lamp or the like to the power source socket 182 when appropriate, the patrol lamp or the like can be used. Accordingly, even when the operation part 7 is surrounded by the cabin 30, it is unnecessary to provide an external power source to the cabin 30.

Figure 19:
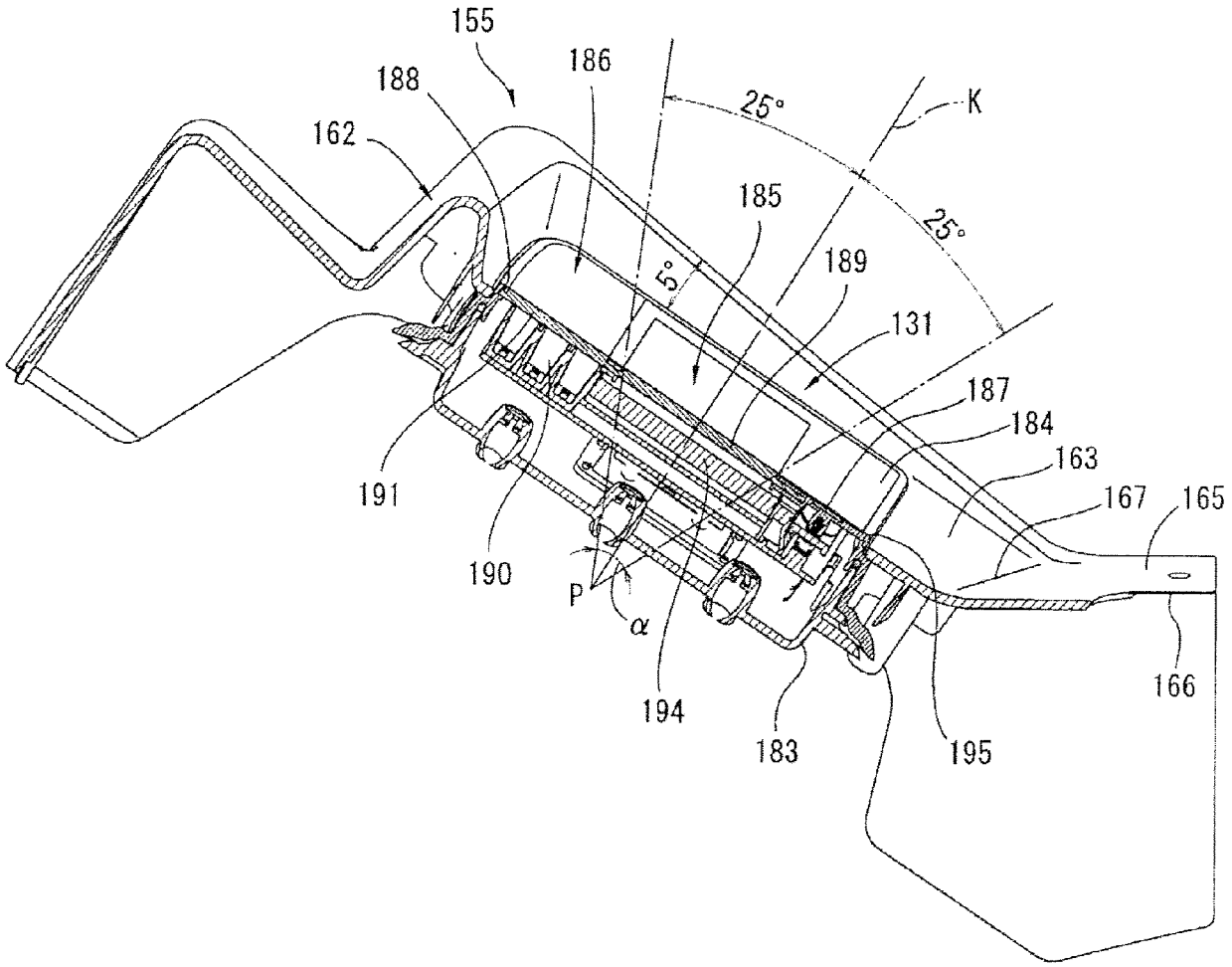
FIG. 19 is a cross-sectional view taken along a line I-I in FIG. 17.
Figure 20:
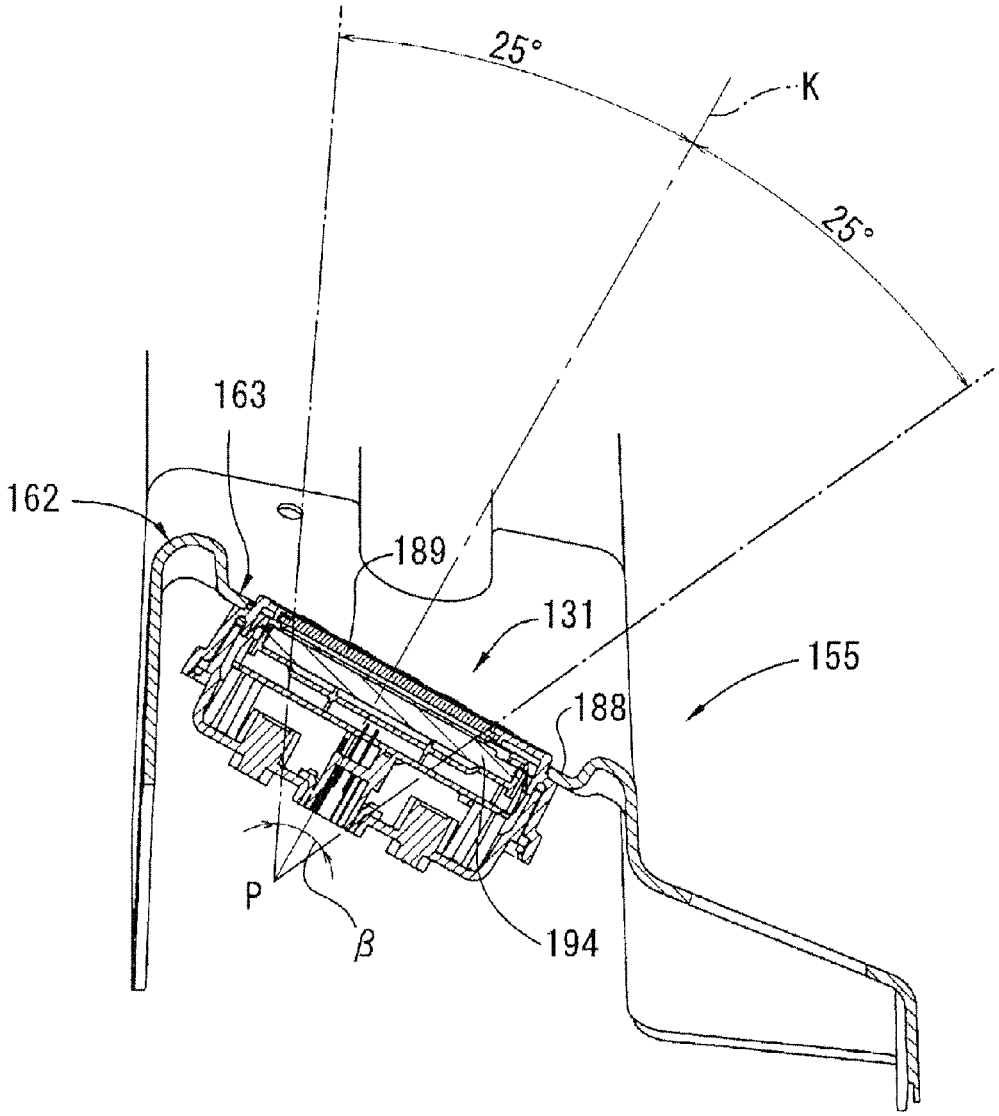
FIG. 20 is a cross-sectional view taken along a line II-II in FIG. 17.

As shown in FIG. 19 and FIG. 20, the monitor 131 is supported on the monitor support portion 162. The monitor 131 is configured such that a main display part 185, a sub display part 186 and a group of display part manipulation switches 187 are arranged on an upper surface portion 184 of the monitor case 183 coplanar with each other in the longitudinal direction. The monitor case 183 is formed into a longitudinally-elongated flat box shape, and a stepped recessed portion 188 is formed on a peripheral edge portion of the upper surface portion 184. The main display part 185 is formed of a liquid crystal display which has a square shape as viewed in a plan view. The main display part 185 is arranged on a center portion of the upper surface portion 184, and displays graphic information, data and the like using liquid crystal. The sub display part 186 is formed of an LED display part. The sub display part 186 is arranged on a front portion of the upper surface portion 184, and displays graphic information, data and the like using LEDs (Light Emitting Diodes). The group of display part manipulation switches 187 is configured such that a plurality of (in this embodiment, five) switches are arranged parallel to each other in the lateral direction just behind the main display part 185. By pushing the respective switches selectively, the respective display parts 185, 186 can be operated. The main display part 185 includes: a transmissive liquid crystal display body 194 which makes use of a property of liquid crystal which can allow and block the transmission of light from a backlight which constitutes a light source; and a display screen portion 189 which is disposed just above the liquid crystal display body 194. The sub display part 186 is constituted by extending a display screen portion 191 just over the LEDs 190.

A monitor upper surface exposure opening 195 having a longitudinally-elongated quadrangular shape is formed in the monitor support portion 162. An upper surface portion 184 of the monitor case 183 is fitted into the monitor upper surface exposure opening 195 from below, and the stepped recessed portion 188 which is formed on the peripheral edge portion of the upper surface portion 184 is engaged with a peripheral edge portion of the monitor upper surface exposure opening 195. In a state where the upper surface portion 184 is exposed from the monitor upper surface exposure opening 195, the monitor 131 is mounted on the monitor support portion 162.

Figure 21:
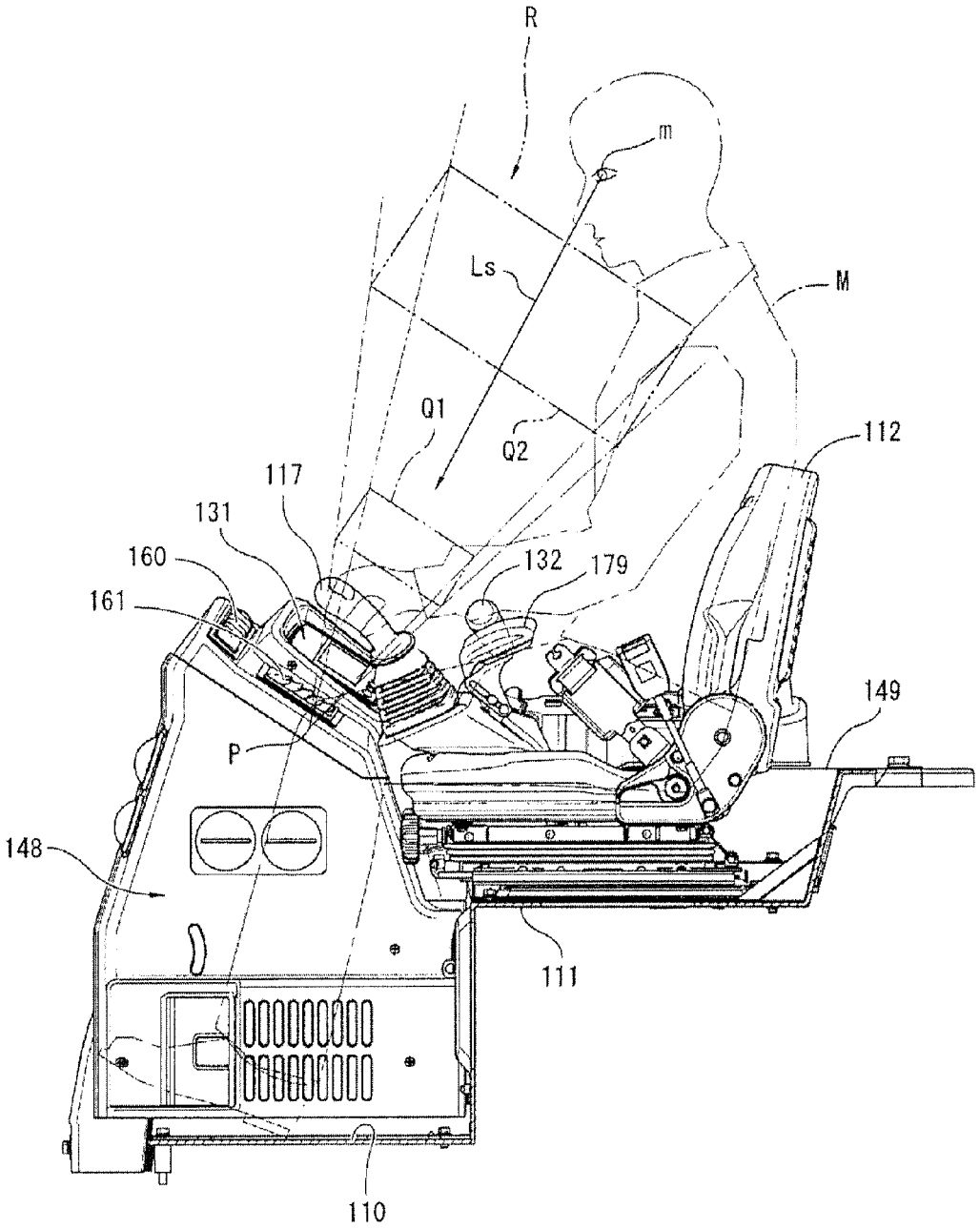
FIG. 21 is an explanatory side view at the time of viewing a monitor.
Figure 22:
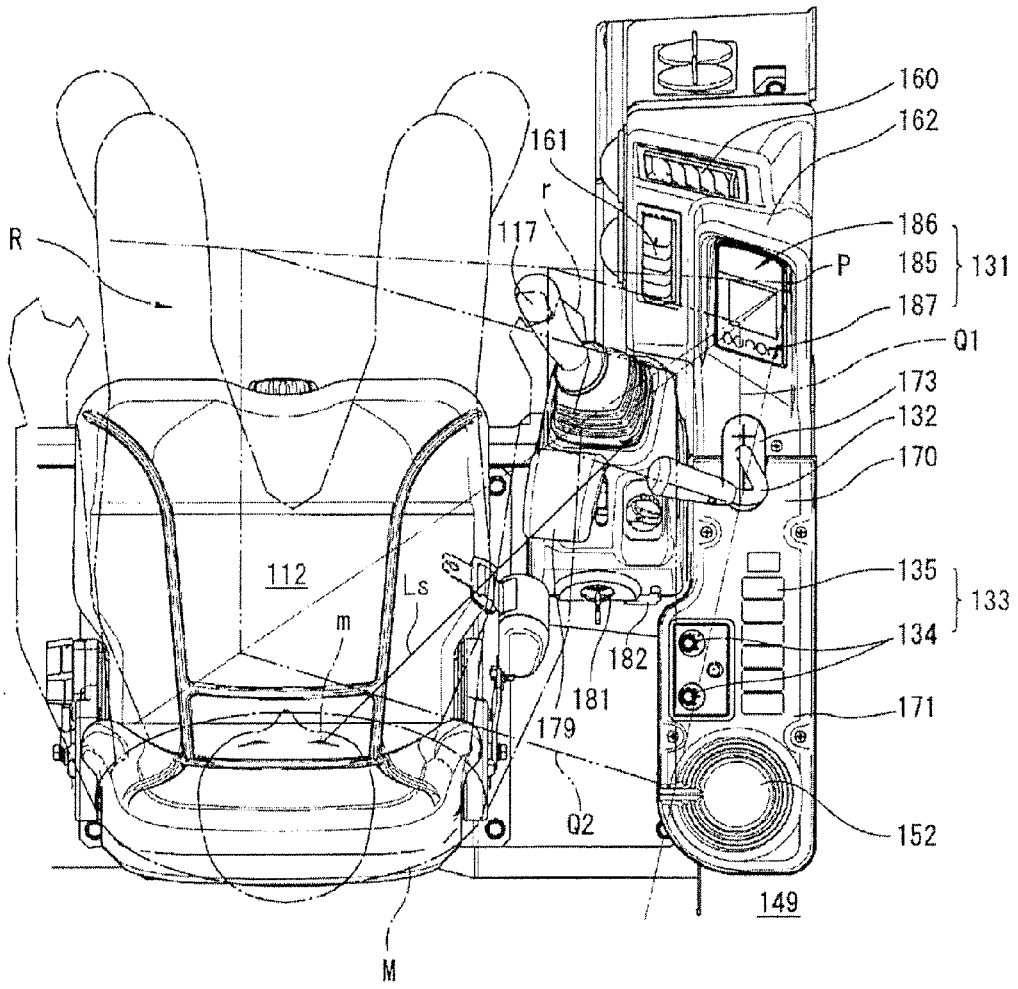
FIG. 22 is an explanatory plan view at the time of viewing the monitor.

In this embodiment, the upper surface portion 184 of the monitor case 183 which constitutes a display screen of the monitor 131 is viewable from the operator M through between the blade lever 132 and the right working part manipulation lever 117 within the field of vision of the operator M. Particularly, as shown in FIG. 21 and FIG. 22, the region of field of vision R of the display screen portion 189 of the main display part 185 having the viewing angles $\alpha$, $\beta$ is increased from a viewpoint P toward an operator M side through the peripheral edge of the display screen portion 189 in a one-point perspective view thus being formed into a quadrangular pyramid shape. Further, within a plane of field of vision Q1 near the lever which is formed in a cross-sectional shape within the region of field of vision R in the vicinity of the blade lever 132 and the right working part manipulation lever 117, and within a plane of field of vision Q2 near the viewpoint which is formed in a cross-sectional shape within the region of field of vision R in the vicinity of the eyes m of the operator M, neither the blade lever 132 and the right working part manipulation lever 117 nor other constitutional members around the monitor 131 are arranged.

Due to such a constitution, a viewpoint of the operator M seated on the driver's seat 112 is always arranged within the region of field of vision R of the display screen portion 189 of the main display part 185. Accordingly, even when the operator M adjusts the driver's seat 112 at the desired position by suitably moving the driver's seat 112, the display screen portion 189 surely falls within the field of vision and hence, visibility of the display screen portion 189 for the operator M can be favorably ensured.

Here, the sub display part 186 is arranged on a front side of the main display part 185 which is a side away from the blade lever 132 and the right working part manipulation lever 117. Accordingly, a viewpoint of the operator M seated on the driver's seat 112 is always arranged within the region of field of vision of the display screen portion 189 of the main display part 185 and the display screen portion 191 of the sub display part 186 both of which constitute the display screen of the monitor 131. As a result, even when the operator M moves the driver's seat 112 by adjustment to a desired position, both the display screen portions 189, 191 are surely arranged within the field of vision and hence, the visibility of the display screen of the monitor 131 for the operator M can be favorably ensured.

[Explanation of Function Part]

Figure 15:
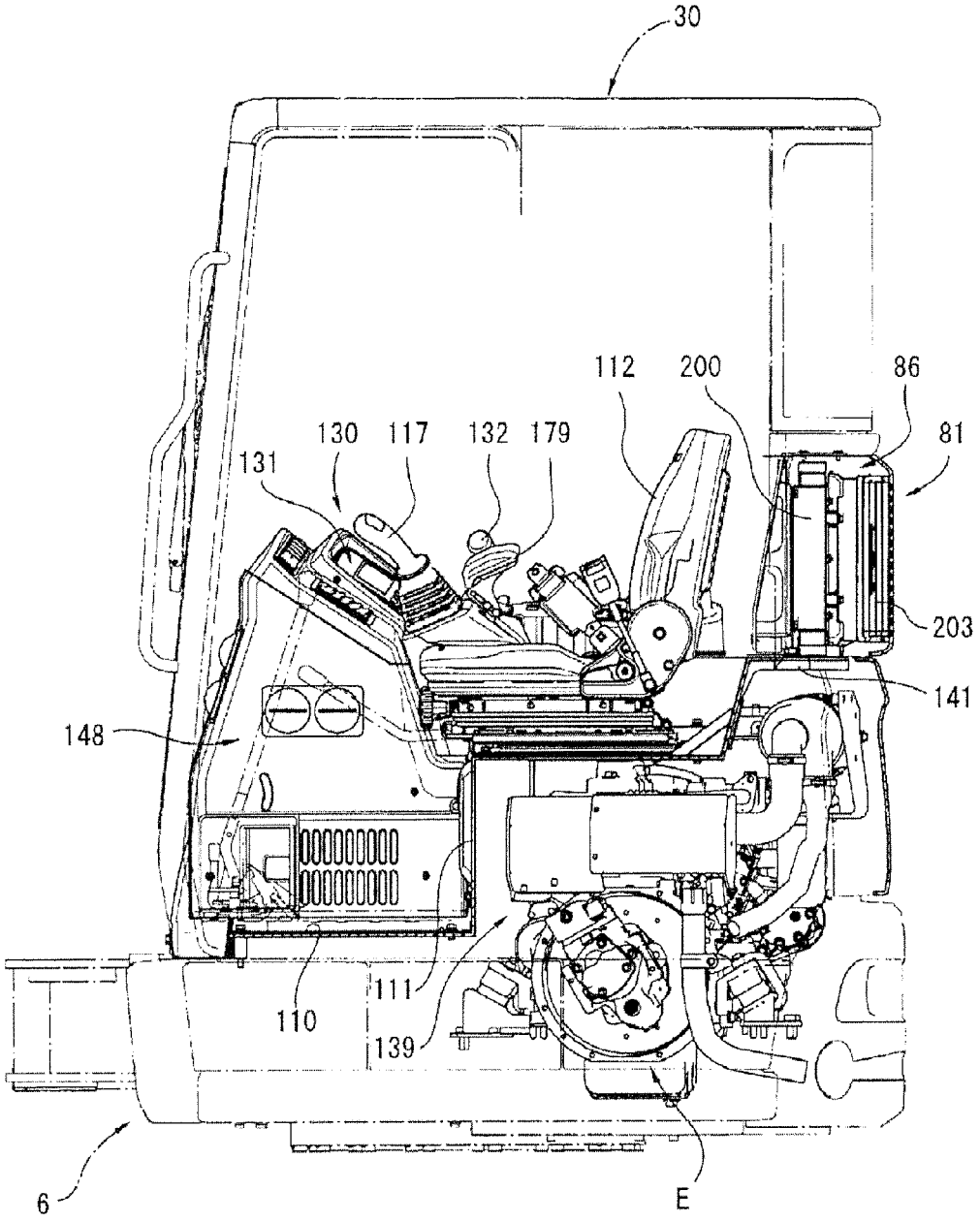
FIG. 15 is an explanatory cross-sectional side view of the operation part.

As shown in FIG. 14 and FIG. 15, the function part 9 is configured such that an engine room 139 is formed below the seat support base 111 and an engine F which constitutes a prime mover part and the like and a support body portion 141 are disposed in the inside of the engine room 139. The engine E is arranged in a state where n axis of the engine E is directed in the lateral direction. The support body portion 141 is integrally formed with a rear portion of the seat support base 111. The support body portion 141 is arranged above a rear portion of the engine E and supports a rear portion of the cabin 30 by an upper end portion of the support body portion 141.

[Explanation of Tank Portion]

The tank portion 8 is, as shown in FIG. 14, configured such that a fuel tank which stores a fuel for driving the engine E and a working oil tank which stores working oil therein (both not shown in the drawing) are arranged adjacent to each other in the back-and-forth direction. These tanks are closed by a front tank cover body 142 which is formed on a right front portion of the turning body 6 in a raised manner while being bent into a curved shape, first and second tank cover bodies 143, 144 which are arranged along a side edge portion of the front portion of the turning body 6 (see FIG. 2 and FIG. 4), an inner wall body (not shown in the drawing) which is raised on a right inner side of the floor plate member 110, and an upper surface cover body 145 which is disposed on upper edge portions of inner wall bodies of these front tank cover body 142 and the first and second tank cover bodies 143, 144 (see FIG. 2 and FIG. 4). An upper side of both tanks can be opened or closed by the upper surface cover body 145.

[Explanation of Housing Part for Housing Condenser and the Like for Air Conditioner]

As shown in FIG. 14 and FIG. 15, the housing part 81 for housing a condenser and the like for an air conditioner is configured such that a condenser 200 for an air conditioner which liquefies a refrigerant whose temperature and pressure are increased due to compression by cooling, a receiver drier 201 which temporarily stores the refrigerant liquefied by the condenser 200 for an air conditioner, and a washer tank 202 are disposed in the inside of the housing space 86. The receiver drier 201 stores a strainer for removing an impurity from a refrigerant and a desiccant for removing moisture from a refrigerant in the inside thereof. Symbol 203 indicates a wind guide body, and symbol 204 indicates a fan.

[Explanation of Panel Part According to Another Embodiment]

Figure 23:
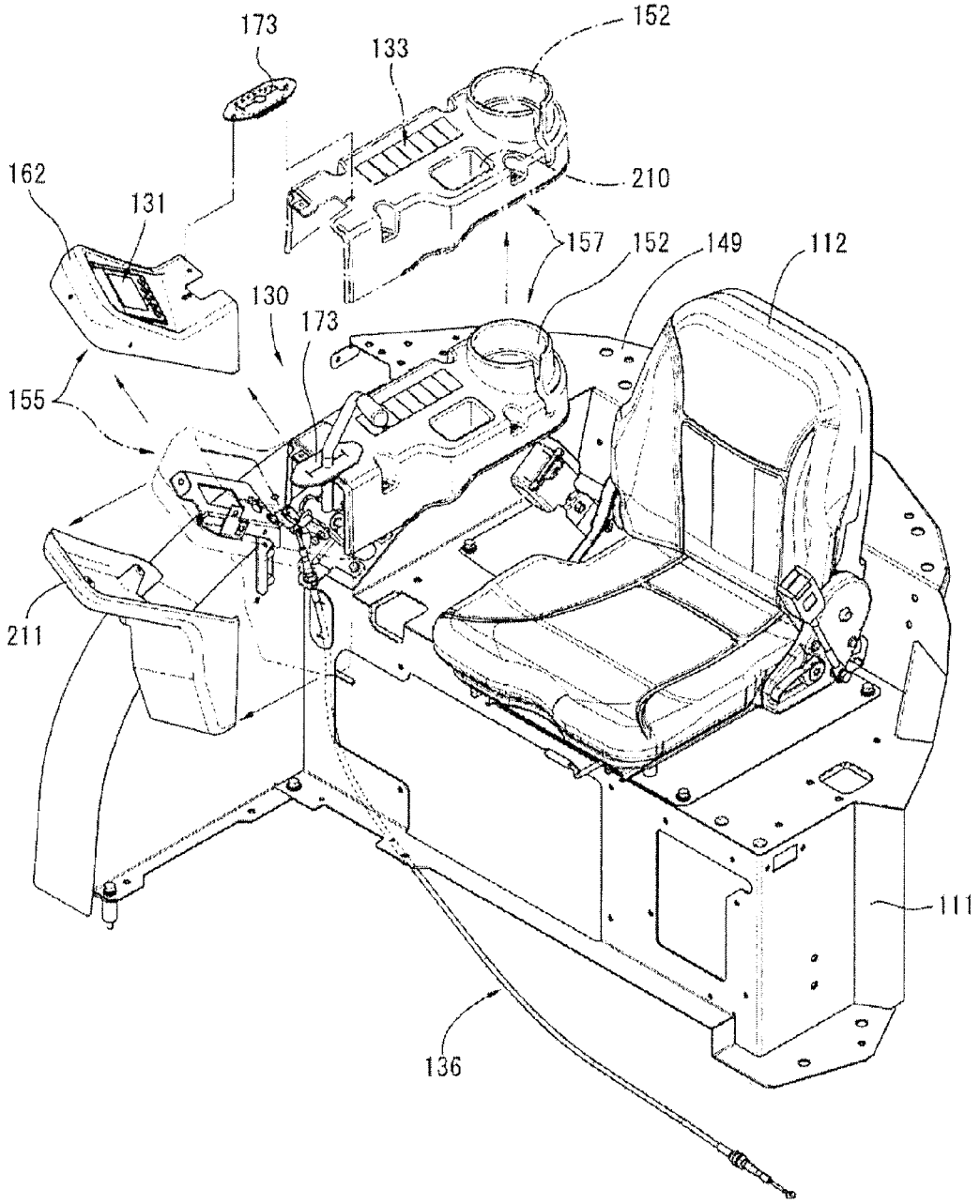
FIG. 23 is an explanatory perspective view of an operation panel part according to another embodiment.
Figure 24:
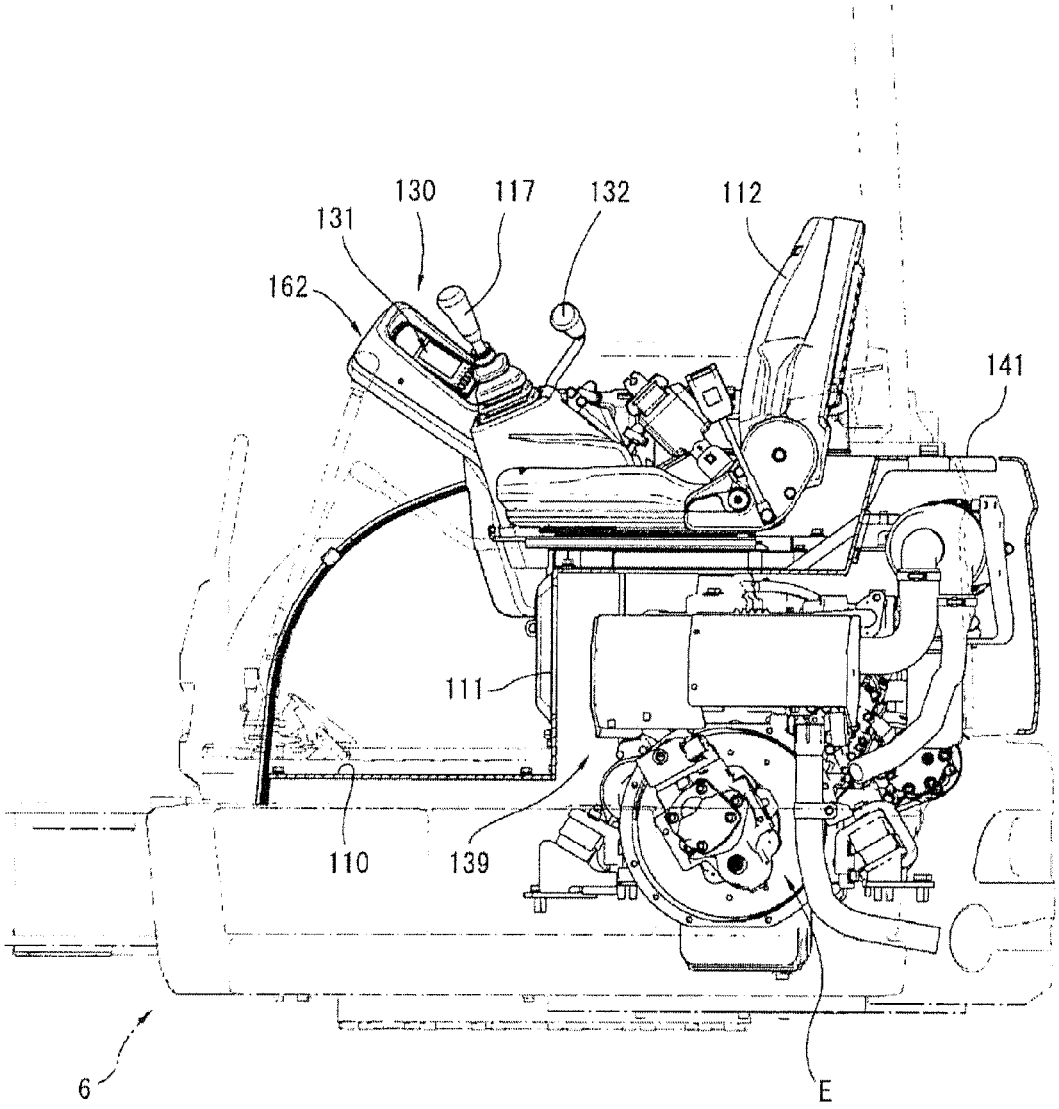
FIG. 24 is a cross-sectional explanatory side view of an operation part according to still another embodiment.
Figure 25:
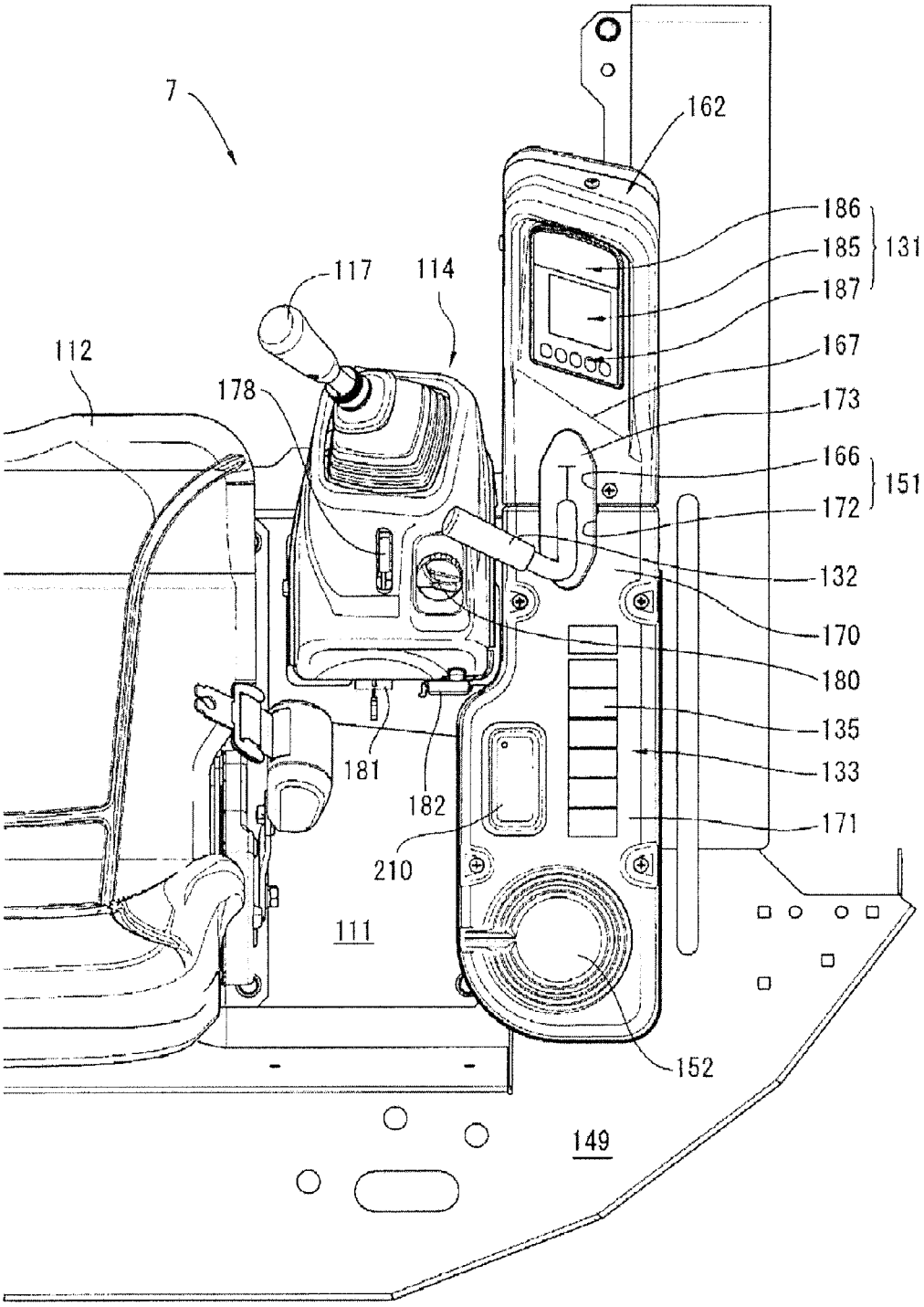
FIG. 25 is an explanatory plan view of an operation panel part according to still another embodiment.

FIG. 23 to FIG. 25 show an operation panel part 130 according to another embodiment. Although the operation panel part 130 has the same basic structure as the operation panel part 130 according to the above-mentioned embodiment, the operation panel part 130 according to another embodiment differs from the operation panel part 130 according to the above-mentioned embodiment with respect to a point that a laterally-elongated upper end discharge portion 160 and a longitudinally-elongated upper end discharge portion 161 are not provided to a body front half portion 155, and a point that a small article container 210 is provided to a body rear half portion 157 in place of the volume-type switches 134.

That is, only a monitor support portion 162 is provided to the body front half portion 155, and a monitor 131 is disposed on the body front half portion 155 by way of the monitor support portion 162. Further, the small article container 210 is provided to a left side portion of a front half portion of a rear portion 171 of the body rear half portion 157 in place of the volume-type switches 134, and a power source socket 182 which is provided to a right side portion of a case fixed portion 175 of a right lever support case 114 and the small article container 210 are arranged close to each other. Symbol 211 indicates a lower cover which covers a lower side of the body front half portion 155 of a panel part body 150.

Due to such a constitution, the power source socket 182 provided to the right side portion of the case fixed portion 175 of the right lever support case 114 and the small article container 210 provided to the panel part body 150 are arranged close to each other. Accordingly, for example, by connecting a mobile phone stored in the small article container and the power source socket 182 to each other via an adapter, the mobile phone can be charged during working of the turning working vehicle.

REFERENCE SIGNS LIST

A: excavation working vehicle
1: traveling machine body
2: excavation part
3: earth removing part
4: traveling part
117: right working part manipulation lever
131: monitor
132: blade lever
151: through hole portion
189: liquid crystal display screen
R: region of field of vision
Ls: visual line
Q1: plane of field of vision near lever
Q2: plane of field of vision near viewpoint

The invention claimed is:

1. A turning working vehicle comprising:
a turning body;
an operation part disposed on the turning body;
a driver's seat arranged on the operation part; and
a working part manipulation lever for manipulating a working part, a monitor for displaying various information, and an outer manipulation lever, which are disposed on either one of left and right sides of the driver's seat,
wherein the monitor is arranged outside and in front of the working part manipulation lever which is in an upright state, and a display screen of the monitor is directed toward a viewpoint side of an operator who is seated on the driver's seat and performs manipulation while viewing a front side, and
wherein the outer manipulation lever is arranged in an upright state behind the monitor and is also arranged behind and outside the working part manipulation lever thus allowing the operator to view the display screen of the monitor between the outer manipulation lever and the working part manipulation lever within a field of vision of the operator.

2. The turning working vehicle according to claim 1, wherein an upper end portion of the working part manipulation lever, an upper end portion of the outer manipulation lever, and a center portion of the display screen of the monitor are sequentially arranged from the driver's seat to the outside on one side, and wherein a height of the operation part from a floor portion is disposed at a low position, and wherein a center portion of the display screen of the monitor, the upper end portion of the working part manipulation lever and the upper end portion of the outer manipulation lever are arranged sequentially from a front side to a rear side thus allowing the operator to view the display screen of the monitor arranged outside and below the driver's seat between the outer manipulation lever and the working part manipulation lever within a field of vision of the operator.

3. The turning working vehicle according to claim 1, wherein a monitor manipulation switch is disposed in the vicinity of the display screen of the monitor, and the monitor manipulation switch is configured to allow the operator seated on the driver's seat to extend his hand between the working part manipulation lever and the outer manipulation lever and to manipulate the monitor manipulation switch.

4. The turning working vehicle according to claim 1, wherein a liquid crystal display, having a viewing angle of a fixed angle in the longitudinal direction and in the lateral direction, is used as the monitor, and a display screen of the liquid crystal display is arranged to be directed toward an operator side such that a viewpoint of the operator seated on the driver's seat is always disposed within a range of field of vision having a pyramidal shape formed by the viewing field angles in the longitudinal direction and in the lateral direction.

5. The turning working vehicle according to claim 2, wherein a monitor manipulation switch is disposed in the vicinity of the display screen of the monitor, and the monitor manipulation switch is configured to allow the operator seated on the driver's seat to extend his hand between the working part manipulation lever and the outer manipulation lever and to manipulate the monitor manipulation switch.

6. The turning working vehicle according to claim 2, wherein a liquid crystal display, having a viewing angle of a fixed angle in the longitudinal direction and in the lateral direction, is used as the monitor, and a display screen of the liquid crystal display is arranged to be directed toward an operator side such that a viewpoint of the operator seated on the driver's seat is always disposed within a range of field of vision having a pyramidal shape formed by the viewing field angles in the longitudinal direction and in the lateral direction.

7. The turning working vehicle according to claim 3, wherein a liquid crystal display, having a viewing angle of a fixed angle in the longitudinal direction and in the lateral direction, is used as the monitor, and a display screen of the liquid crystal display is arranged to be directed toward an operator side such that a viewpoint of the operator seated on the driver's seat is always disposed within a range of field of vision having a pyramidal shape formed by the viewing field angles in the longitudinal direction and in the lateral direction.

* * * * *